US008632290B2

(12) United States Patent
Alan

(10) Patent No.: US 8,632,290 B2
(45) Date of Patent: Jan. 21, 2014

(54) AUTOMATED PARKING SYSTEM

(75) Inventor: Christopher Alan, Los Angeles, CA (US)

(73) Assignee: Auto Parkit, LLC, Los Angeles, CA (US)

( * ) Notice: Subject to any disclaimer, the term of this patent is extended or adjusted under 35 U.S.C. 154(b) by 89 days.

(21) Appl. No.: 13/008,578

(22) Filed: Jan. 18, 2011

(65) Prior Publication Data

US 2011/0182703 A1 Jul. 28, 2011

Related U.S. Application Data

(60) Provisional application No. 61/297,176, filed on Jan. 21, 2010.

(51) Int. Cl.
*E04H 6/22* (2006.01)
*E04H 6/12* (2006.01)
*E04H 6/30* (2006.01)

(52) U.S. Cl.
USPC ..... 414/234; 414/231; 414/253

(58) Field of Classification Search
USPC ..... 414/231, 234, 253
See application file for complete search history.

(56) References Cited

U.S. PATENT DOCUMENTS

| | | | | | |
|---|---|---|---|---|---|
| 4,279,563 | A * | 7/1981 | Miller | 414/611 |
| 5,049,022 | A * | 9/1991 | Wilson | 414/253 |
| 5,464,082 | A * | 11/1995 | Young | 191/2 |
| 6,049,745 | A * | 4/2000 | Douglas et al. | 701/23 |
| 6,662,077 | B2 * | 12/2003 | Haag | 700/217 |
| 6,851,921 | B2 * | 2/2005 | Haag | 414/800 |
| 2002/0164234 | A1 * | 11/2002 | Haag | 414/277 |
| 2006/0043176 | A1 * | 3/2006 | Meyerhofer et al. | 235/384 |
| 2006/0255119 | A1 * | 11/2006 | Marchasin et al. | 235/375 |
| 2007/0112620 | A1 * | 5/2007 | Johnson et al. | 705/13 |
| 2007/0128009 | A1 * | 6/2007 | Lee | 414/253 |
| 2008/0251575 | A1 * | 10/2008 | Bowling et al. | 235/375 |
| 2009/0026254 | A1 * | 1/2009 | Johnson et al. | 235/375 |
| 2009/0078172 | A1 * | 3/2009 | Kaufmann et al. | 108/57.17 |
| 2009/0148259 | A1 * | 6/2009 | Shani | 414/231 |
| 2009/0216876 | A1 * | 8/2009 | Hsieh et al. | 709/224 |

FOREIGN PATENT DOCUMENTS

| | | | | |
|---|---|---|---|---|
| KR | 2006027105 A1 * | 3/2006 | | G06Q 50/00 |
| KR | 2006027105AH * | 3/2006 | | G06Q 50/00 |
| WO | WO2009/039499 A1 | 3/2009 | | |

* cited by examiner

*Primary Examiner* — Scott Lowe
(74) *Attorney, Agent, or Firm* — Goodwin Procter LLP

(57) ABSTRACT

An automated parking system for a parking structure includes a controller which receives a vehicle loading request from a vehicle customer. A loading bay accepts the vehicle and transfers to the parking system. Equipment is provided for transferring the vehicle horizontally and vertically through the parking system. The vehicle parking system includes a rack structure that is integrated as part of the parking structure.

24 Claims, 36 Drawing Sheets

AUTOMATED PARKING SYSTEM

CROSS-REFERENCE TO RELATED APPLICATIONS

This application claims the benefit of U.S. 61/297,176 filed Jan. 21, 2010, which application is fully incorporated herein by reference.

BACKGROUND OF THE INVENTION

1. Field of the Invention

The present invention is related generally to automated vehicle parking systems and methods, and more particularly to automated parking systems and methods that can perform multiple storage and retrieval operations simultaneously without the use of complex mechanical devices 2. Description of the Related Art Automated parking garage systems have been employed since the late 1950's utilizing crane systems, conveyors, hydraulics and pneumatics to transport and store vehicles within a parking structure. Recently, more advanced garage systems have been developed which include computer-controlled, specialized equipment for carrying vehicles to assigned parking spaces in a way similar to the way that computerized assembly lines or warehouses store and retrieve miscellaneous goods. In such assembly line and warehouse systems, a computer assigns a location for each item as it is received from its manufacturer, and robotic equipment carries each item to its assigned location. The same equipment is dispatched to the location when the item requires retrieval. Often, the items stored in a warehouse are placed on pallets to facilitate transportation and storage of the items. The use of pallets as supporting elements for the transport and storing of vehicles is also typical of more advanced automated parking garage systems.

Automated parking garage systems typically utilize one of two methods to store and retrieve vehicles. One method employs pallets and assigns a separate pallet to each vehicle storage bay. In such systems, when a vehicle is to be parked or stored in a storage bay, the pallet associated with the storage bay is transported from the storage bay to the garage entrance where the vehicle is located. The vehicle is loaded onto the pallet and the pallet carrying the vehicle is transported to the storage bay where both the pallet and vehicle are stored until retrieved.

When a stored vehicle is to be retrieved, the pallet carrying the vehicle is transported from the storage bay to a garage exit. The vehicle is then unloaded from the pallet, and the pallet is transported back to the storage bay until it is needed again to store a vehicle.

This first method has significant shortcomings. A first shortcoming is the inefficient use of time when storing or retrieving a vehicle. Using the first prior art method, a customer parking a vehicle is required to idly wait while a pallet is delivered to the garage entrance from an assigned storage bay. Although garages may provide a limited pallet buffer (e.g., five pallets), it is not enough to handle the queues that may occur during periods of high volume business, such as in the morning and afternoon.

A second shortcoming is that the first prior art method of handling empty pallets impedes the throughput of the garage and fails to provide an endless, continuing and timely stream of pallets.

A further shortcoming of this first method is that handling empty pallets impedes the primary purpose of an automated parking garage, that is, the storing and retrieving of vehicles.

Specifically, the same equipment that is used to store and retrieve vehicles is utilized to handle empty pallets thereby promoting inefficient utilization of that equipment.

Yet another significant shortcoming of the first method is that it can only handle one vehicle and one procedure at a time. Thus, systems employing the first prior art method cannot park an incoming vehicle at the same time they are retrieving an empty pallet, and vice versa. As a result, an unacceptably long queue often forms at the entrance of such a garage during periods of high volume business.

In a second method, a single carrier module is used to service all storage bays without the use of pallets. In such systems, the module is stored at an idle position in an aisle of the garage when it is not in use. When a vehicle is to be parked or stored in a storage bay, the vehicle is loaded from an entry/exit station onto the module. The module carrying the vehicle is transported to the storage bay where the vehicle is unloaded. The empty module is transported back to the idle position while the vehicle remains stored until it is retrieved. Typically, the vehicle is loaded/unloaded to/from the module using either the vehicle's own drive system or a crane that traverses the aisles and reaches from the foundation to the roof.

When a stored vehicle is to be retrieved, the module is transported from the garage entrance to the storage bay in which the vehicle is stored. The vehicle is loaded onto the module and the module carrying the vehicle is transported to the garage exit. The vehicle is then unloaded from the module, and the empty module is transported to the garage idle position where it remains until it is needed to store or retrieve a vehicle.

Although this second method eliminates the need to handle empty pallets, it has several shortcomings. Specifically, it requires excessive handling of the vehicle such as grabbing the tires in one way or another. The second prior art method also makes inefficient use of time when storing and retrieving a vehicle. Further, using the second prior art method puts vehicles at risk for being soiled during transportation (such as by oil or hydraulic fluid from the crane).

Another characteristic of systems in the market is that vertical and horizontal travel of the travelling vehicle lifter do not occur simultaneously. The operations are performed separately, which significantly slows the process of storing or retrieving a vehicle. This is undesirable for busy installations, such as at an airport or train station, though acceptable for garaging the cars of customers in a small block of apartments.

Existing automated parking garages and associated technologies pursue the goal of reducing the average amount of space required to park a car. The most rudimentary form of automated parking involves replacing ramps with an elevator or lift system. More sophisticated systems employ materials handling technologies to maneuver vehicles on systems of vertical lifts and horizontal tracks. Over the years, a variety of such systems have been described. The major distinctions are that the existing systems employ pallets or direct carrier mechanisms or such systems are exclusively vertical, or combine horizontal and vertical movement mechanisms.

Several systems employ pallets to support vehicles during the handling process. In these pallet-based systems, the customer arrives at the parking garage and drives his or her car onto a pallet assigned to it for the duration of its storage. A carrier then arrives from a location within the garage and lifts the pallet. The carrier then moves the pallet to a parking space on the same floor or to a lift that carries the pallet to a different floor. If the pallet is moved to a different floor, a different carrier meets the pallet at the lift and moves the pallet to its assigned storage location. The floor plan of such garages is organized by a perpendicular arrangement of longitudinal circulation tracks and transverse tracks that provide access for the carrier to store and retrieve the pallets. Typically, a carrier transports a pallet to the intersection adjacent to the designated storage location, and a mechanism transfers the pallet off of the carrier into the storage position on the transverse track.

The depth of storage of the pallets along the transverse axis is generally limited to the space adjacent to the circulation track, plus one or two additional tandem spaces. The space is limited due to the difficulty of shuffling pallets to positions adjacent to the circulation track which are accessible to the carriers. This system is also disadvantageous, because the entire parking structure must be built and configured to allow the carriers to move thereabout to carry the pallets to and from their storage locations. In addition, since the system depends on the carrier(s) to store and retrieve the vehicles, the system may take a substantial amount of time to retrieve or store a vehicle during peak parking/retrieval times.

In other parking systems, such as direct handling systems, the customer drives his or her vehicle onto a cradle that supports the vehicle's tires. A comb-like handling device then lifts the vehicle off the cradle and carries it to its storage location, where the vehicle is placed on another storage cradle. Where direct handing is used in horizontal configurations, the carrier mechanism runs along a longitudinal track and deposits vehicles on cradles positioned adjacent to the track. Several direct-handling systems are known that use an elevator-like mechanism and a turntable to access storage spaces adjacent to an elevator shaft. In some prior art garages, an elevator or crane mechanism travels along the longitudinal axis of a multistory space, storing and retrieving vehicles or pallets onto racks adjacent to the vertical hoist way.

Accordingly, there is a need for an automated parking system 10 that can perform multiple storage and retrieval operations simultaneously without the use of complex mechanical devices. There is a further need for a system that is adaptable to any layout or configuration and can store vehicles in either a perpendicular orientation or a parallel orientation, and can be designed to park vehicles in tandem and other configurations or depths. There is a further need for an automated parking system 10 that does not require an additional building to house the equipment.

SUMMARY OF THE INVENTION

Accordingly, an object of the present invention is to provide automated parking systems and methods that are designed as a series of building block modules, both mechanically and electrically, and can be combined in any combination to create a unique application for each instillation using standards components.

Another object of the present invention is to provide automated parking systems and methods that use simple electrical mechanical devices that required no hydraulic fluids.

A further object of the present invention is to provide automated parking systems and methods that are designed with flexibility that it could recognize and store a variety of sized loads.

Yet another object of the present invention is to provide automated parking systems and methods that are designed to protect the vehicle and store the vehicle with out making any contact with the vehicle.

Still another object of the present invention is to provide automated parking systems and methods that are reliable and use off the shelf components in mechanical and electrical equipment assemblies.

Another object of the present invention is to provide automated parking systems and methods that are expandable to accommodate any conceivable number of storage cells.

Yet another object of the present invention is to provide automated parking systems and methods that is user friendly to the user and maintenance personnel and creates a safe and secure environment.

A further object of the present invention is to provide automated parking systems and methods that compatible with all third party devices and allow for remote retrieval of vehicles.

Yet another object of the present invention is to provide automated parking systems and methods that have mechanical and electrical equipment suitable for plug and play type and require no special skill or tools to replace worn or broken components.

A further object of the present invention is to provide an automated parking system that is integrated in a parking structure.

These and other objects of the present invention are provided in a vehicle parking system for a parking structure that includes a controller which receives a vehicle loading request from a vehicle customer. A loading bay accepts the vehicle and transfers to the parking system. Equipment is provided for transferring the vehicle horizontally and vertically through the parking system. The vehicle parking system includes a rack structure that is integrated as part of the parking structure.

In another embodiment of the present invention, a vehicle parking control system for a parking structure includes a controller that receives a vehicle loading request from a vehicle customer. A loading bay of the parking structure receives a customer vehicle. Sensors are positioned to determine one or more dimensions of the customer vehicle. An electronic verification device verifies a customer ID.

BRIEF DESCRIPTION OF THE DRAWINGS

FIG. 12 illustrates an embodiment of the present invention where a loading bay has sensors that measure the vehicle and determine which size cell the vehicle should be stored in.

DETAILED DESCRIPTION OF THE PREFERRED EMBODIMENTS

In one embodiment of the present invention, an automated parking system 10 is provided for a parking structure. The automated parking system 10 includes a rack structure that is integrated as part of the parking structure.

Figure 1A:
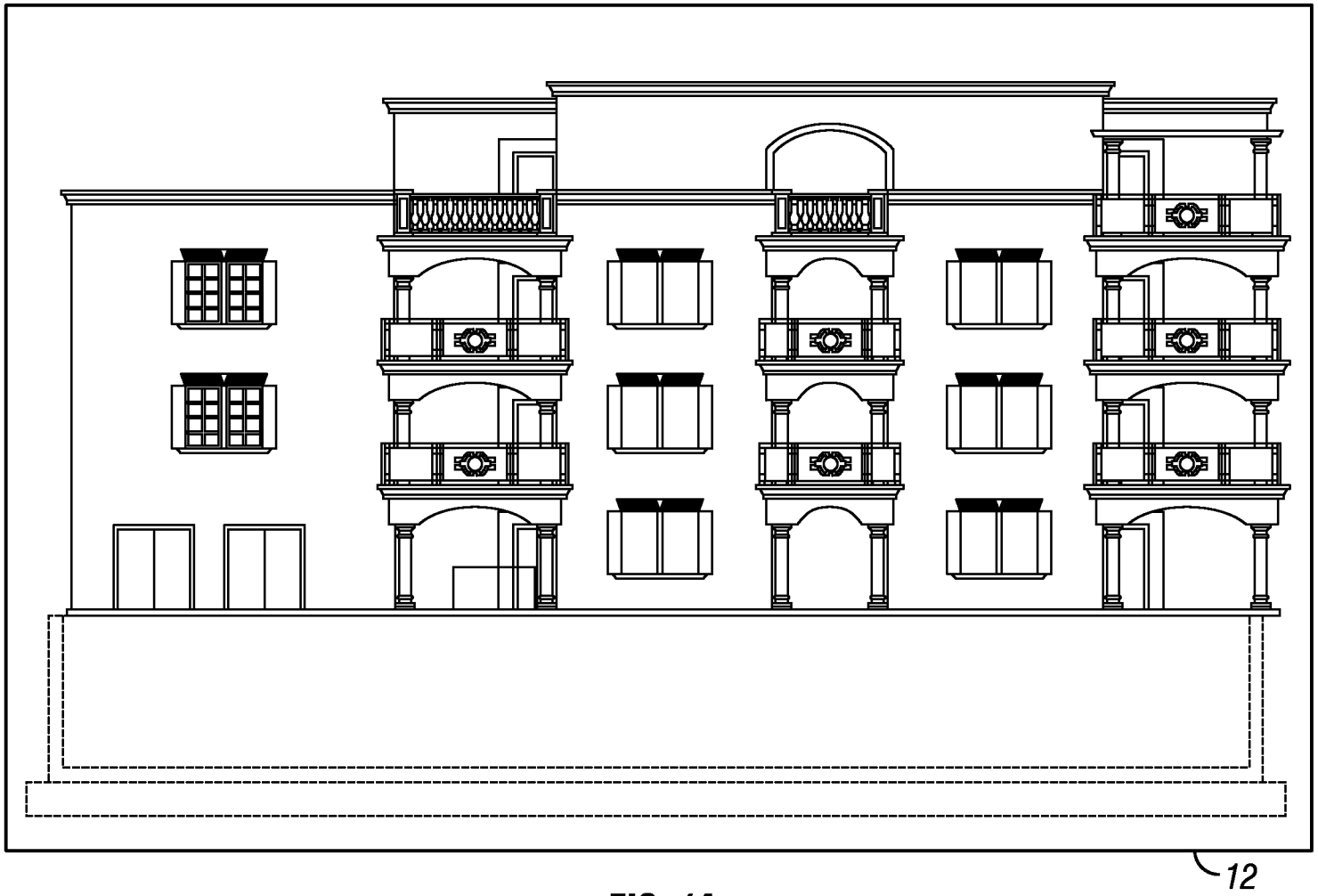
FIGS. 1(*a*) through 1(*f*) illustrates various embodiments of the automated parking control system of the present invention that is integrated with a parking structure.

The automated parking system 10 can include: main control panels 18, shuttle control panels 38, lift control panels 58, loading bays 64, lifts 72, turntables 74 (turntables can be integrated into the lift, shuttle, or loading bay), shuttles 36, powered storage rack CDLR conveyors 14, non-powered storage rack CDLR conveyors 14, and the like. FIGS. 1*a,b,c*, and *d* and 2*a,b,c*, and *d* illustrate two embodiments of the automated parking structures 12 and there automated parking systems 10. The automated parking system 10 can be a pallet based system. The designed pallet can be transferred throughout the automated parking system 10 by turntables, lifts and shuttles to the various storage cells. Each piece of equipment can be equipped with a chain drive live roller (CDLR) conveyor. The CDLR conveyors 14 can be driven via a motor or a parasitic drive 48.

In various embodiments, the automated parking control system 10 of the present invention can, (i) be a highly available control system design that can have a redundant main control panel controller, (ii) is a high reliability design that can include a separate safety network, (iii) can have a modular building block design, (iv) is intended to be operated continuously 24 hours per day, 7 days per week and can be operated in an unattended parking environment, (v) is responsible for controlling all of the equipment in the automated parking system 10, (vi) is responsible for distribution of power to the entire automated parking system 10, and the like.

Figure 3:
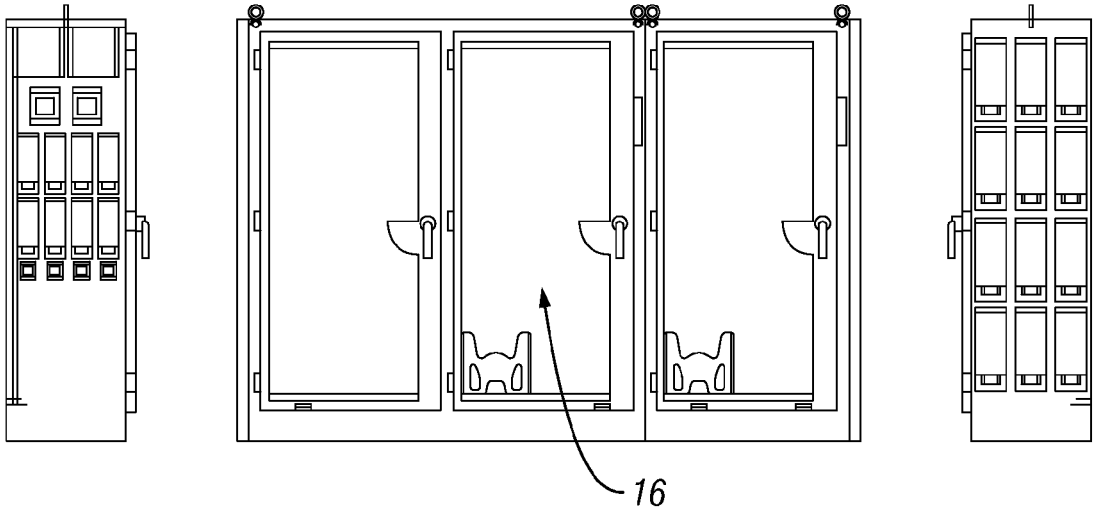
FIGS. 3 and 4 illustrate an overall control system configuration overview of the automated parking system for one embodiment of the present invention.
Figure 3:
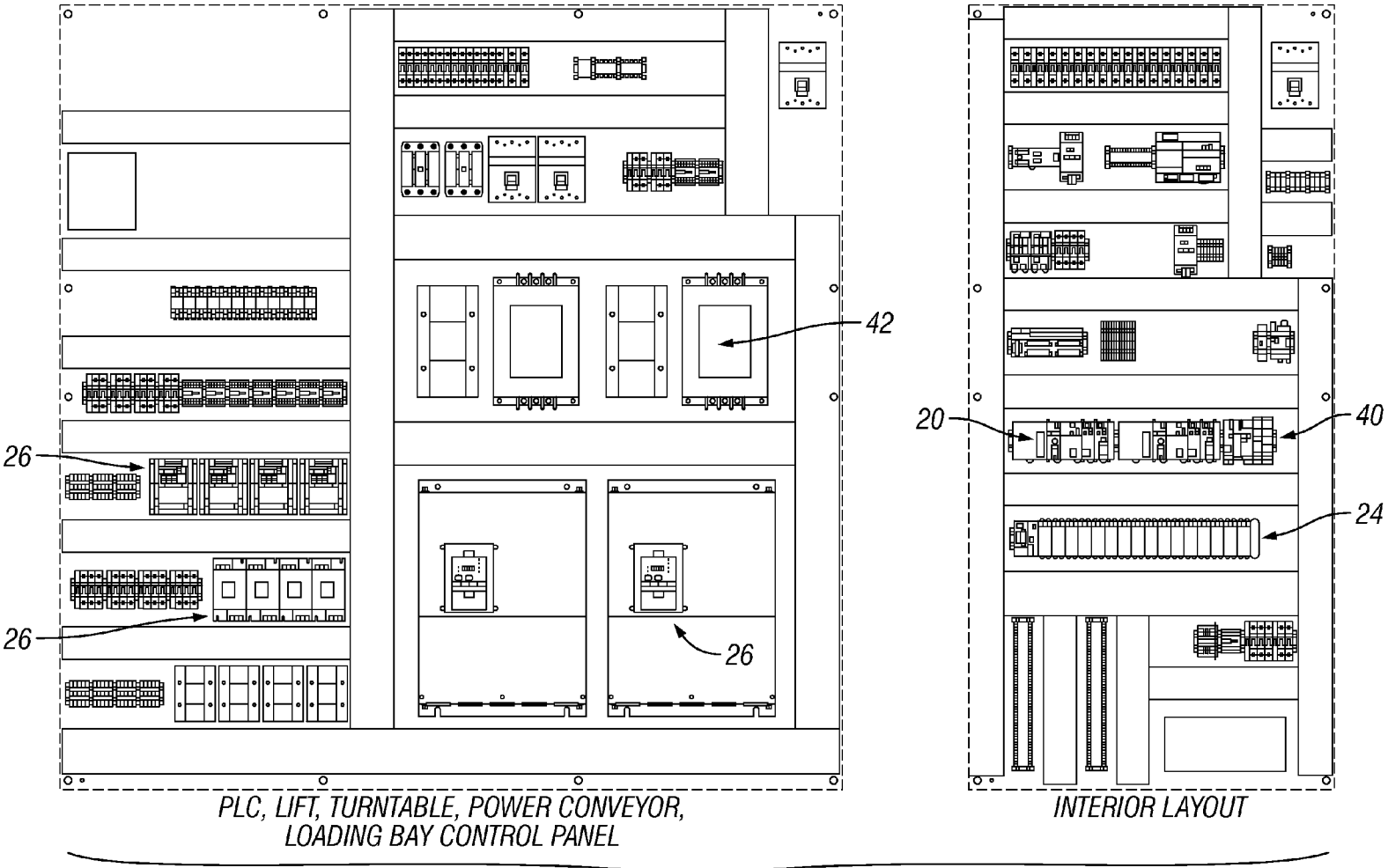
Figure 4:
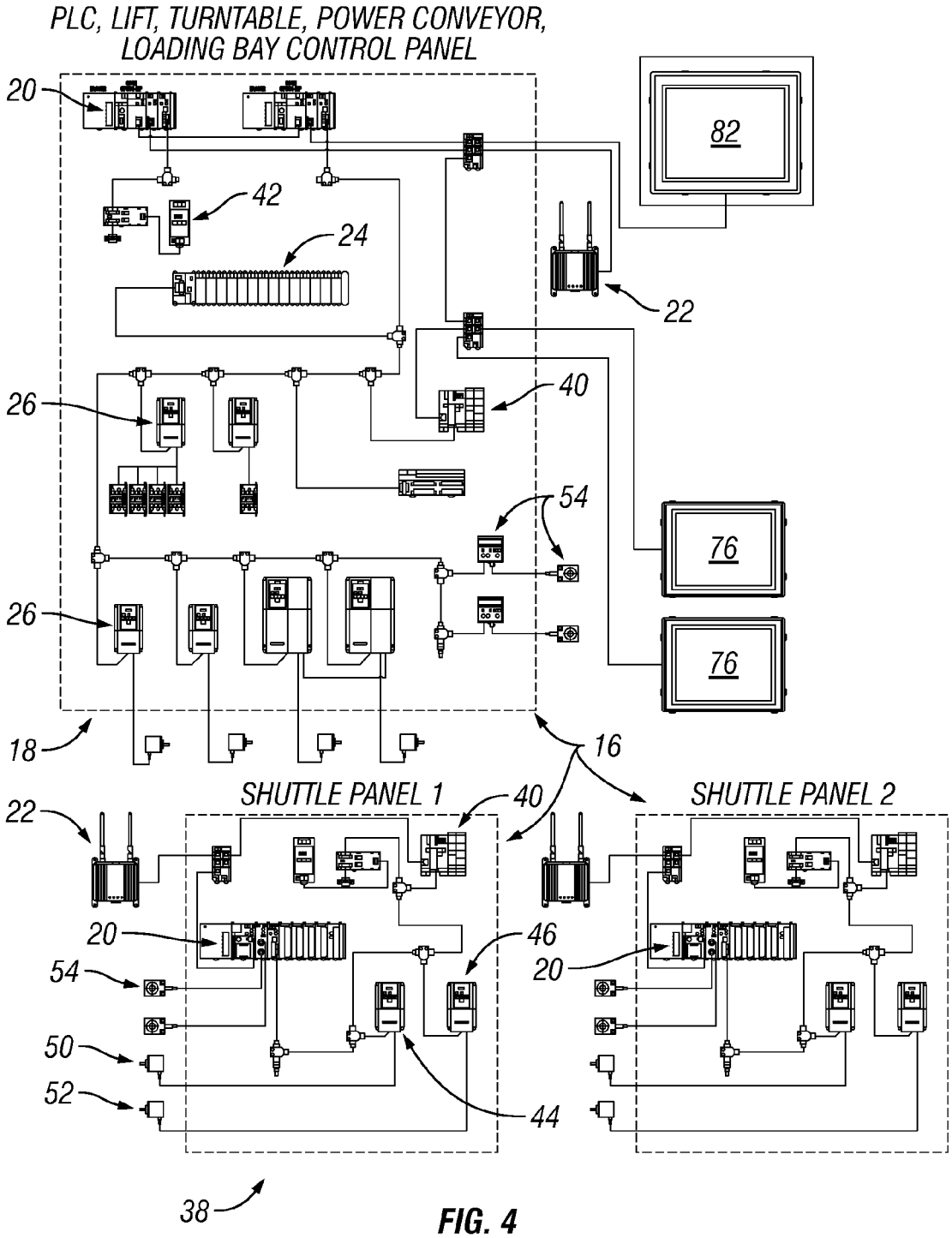

FIGS. 3 and 4 illustrate an overall control system 16 configuration overview of the automated parking system 10 for one embodiment of the present invention. The control panel 18 can be an UL rated panel enclosure that houses the systems controls. The main control panel 18 can use industrial programmable logic controllers (PLC) 20 to operate the automated parking system 10. The PLCs 20 manage the power and data distribution to the various components of the system. The control panel 18 contains a DeviceNet network 22 and a series of DeviceNet Input/Output (I/O) blocks 24 for distributing data. In this embodiment the main control panel 18 houses variable frequency drive controls 26 for the lift motors 28, turntable motors 30, powered rack conveyors 32, and a powered lift conveyor 34. The main control panel 18 also consists of a wireless Ethernet network used to communicate data to the shuttles in the system. Also included in the main control panel 18 are various (I/O) blocks, transformers, fuses, and similar electrical components.

A main control panel 18, PLC, can be used to control the entire parking structure 12 and provides for power distribution to the various elements and systems. The main control panel 18 can be stored in an area away from public access in the storage vault or other small room. Wireless communication can be utilized to communicate I/O data to the shuttle and other devices. Power can be delivered to a shuttle 36 via a power bus rail 72 and the like. The main control panel 18 communicates with the shuttle control panel 38 located on the shuttle 36. The shuttle control panel 38 can include: a PLC 20, safety network controller 40, Ethernet, power supply 42, shuttle traversing motor drive 44, shuttle powered conveyor drive 46, parasitic motor drive 48, traverse encoder 50, conveyor encoder 52, and RFID readers/systems 54. Each shuttle 36 manages the storage and retrieval operations for the level/section in which it is assigned. This allows for an unlimited expansion of the control system 16 design.

In one embodiment, the main control panel 18, loading bay panel 56, lift panel 58, powered rack panels 60, and the like, can be combined into one large control panel 18. Consolidating the main control panel 18 with other sections, including but not limited to the loading bay/lift 62, powered cell sections and the like into one panel reduces the amount of space required for the panels as well as saves in the cost of wires, cable, conduits and the like. The cost of the control panel 18 can also be reduced as some of the components can be shared, including but not limited to, transformers, power supplies and the like.

Modularity can be maintained both in the selection of hardware, layout and configuration of the hardware, and the system program. A complete parking structure 12 configuration and design can be constructed using a combination of pre-defined sections so these sections can be replicated and modularized for subsequent projects. The pre-defined sections can include the main control, loading bay 64, lift 62, shuttle 36, parasitic and powered conveyors or cells 66. A program can be designed in a modular format so that these modules can be re-used thus minimizing recurring engineering and system configuration on future projects.

In one embodiment, the control panel 18 is painted steel. The main control panel 18 can be stored in an enclosed area away from public access. The main control panel 18 can be mounted in a manner to be coordinated with system layout drawings.

A lift 62 lowers and raises vehicles between a loading bay 64 level and the other levels of the parking garage. The lift 62 can be integrated together with a loading bay 64 for smaller scale installations or can be located within the storage rack. The lift 62 travels up or down to deliver or retrieve a vehicle to/from a different floor (level). The lift 62 either receives or delivers the vehicle to/from a shuttle 36 or powered cells. For parking or delivery of a vehicle, the lift 62 travels to the appropriate parking level to deliver a vehicle. When the lift 62 arrives at the appropriate level, it delivers the vehicle to either the shuttle 36 or powered cell 66 and transfers the vehicle as soon as the receiving section is ready. After the vehicle is transferred to the next section (shuttle 36 or powered cell 66), it is ready to accept the next command. For vehicle return, the lift 62 travels (up or down) to the appropriate parking level to retrieve the vehicle. When the lift 62 arrives at the appropriate level, it waits for the vehicle to be delivered from the shuttle 36 or powered cell 66. After the vehicle is received on the lift 62, it moves up or down to the loading bay 64 level. When the vehicle arrives at the loading bay 64 level, the vehicle can be available for the customer to receive his vehicle. After the vehicle leaves the parking structure 12, the lift 62 can be ready to accept the next command.

Figure 2A:
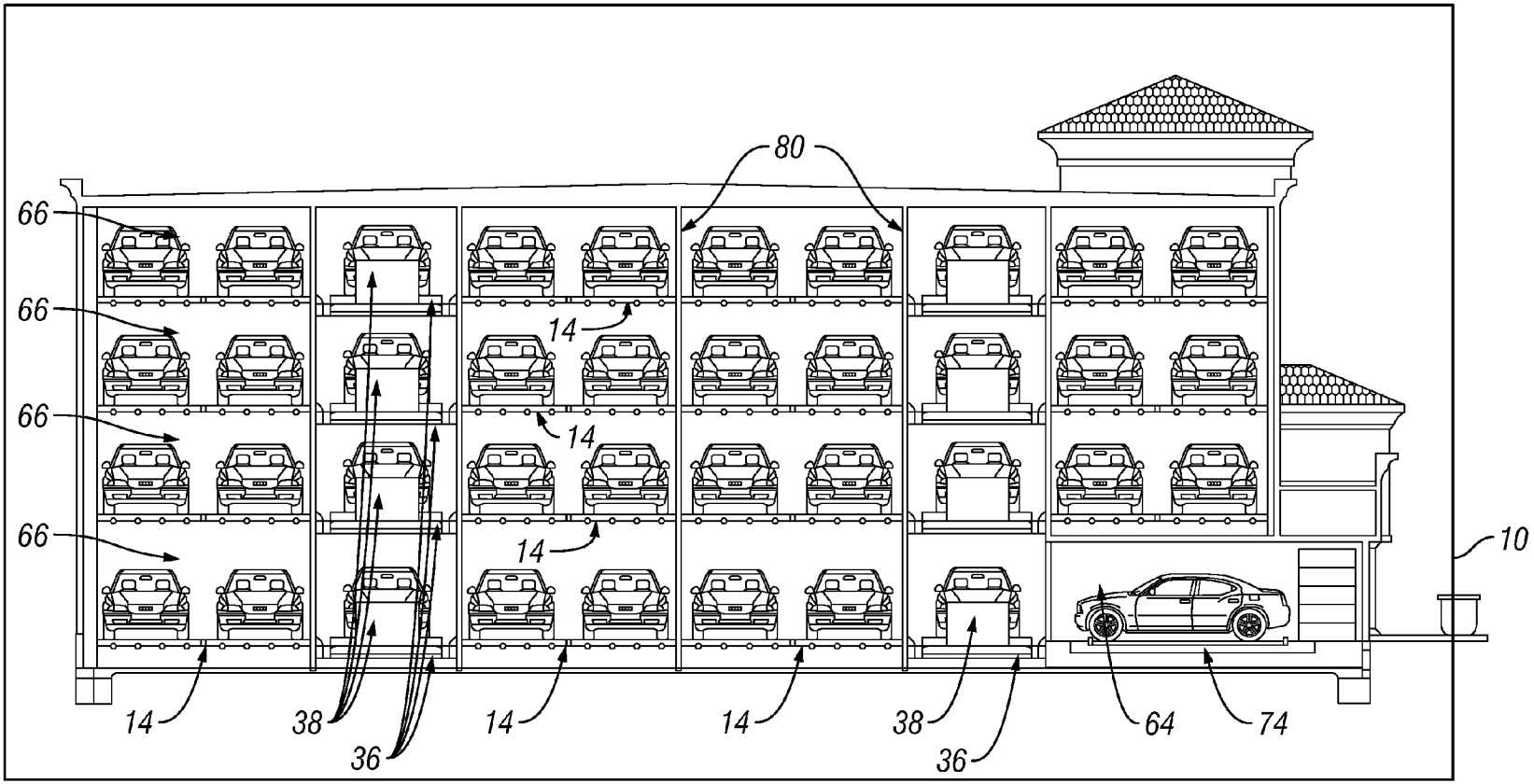
FIGS. 2(*a*) through 2(*d*) also illustrate various embodiments of the automated parking control system of the present invention that is integrated with a parking structure.
Figure 2B:
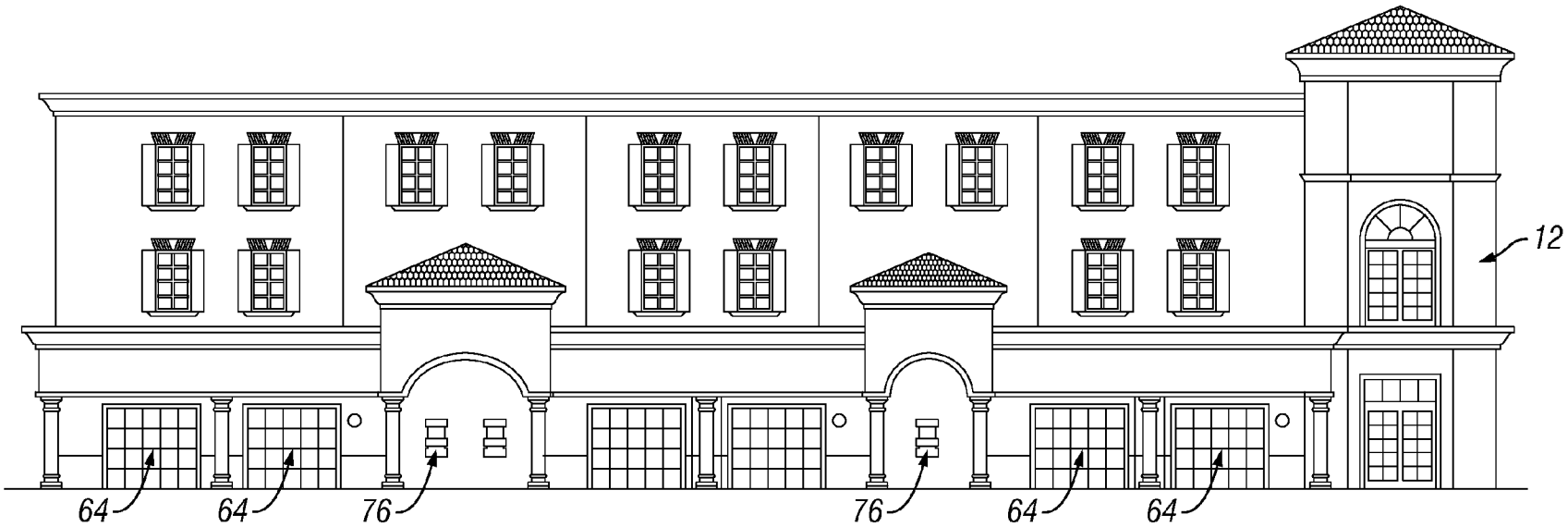
Figure 2C:
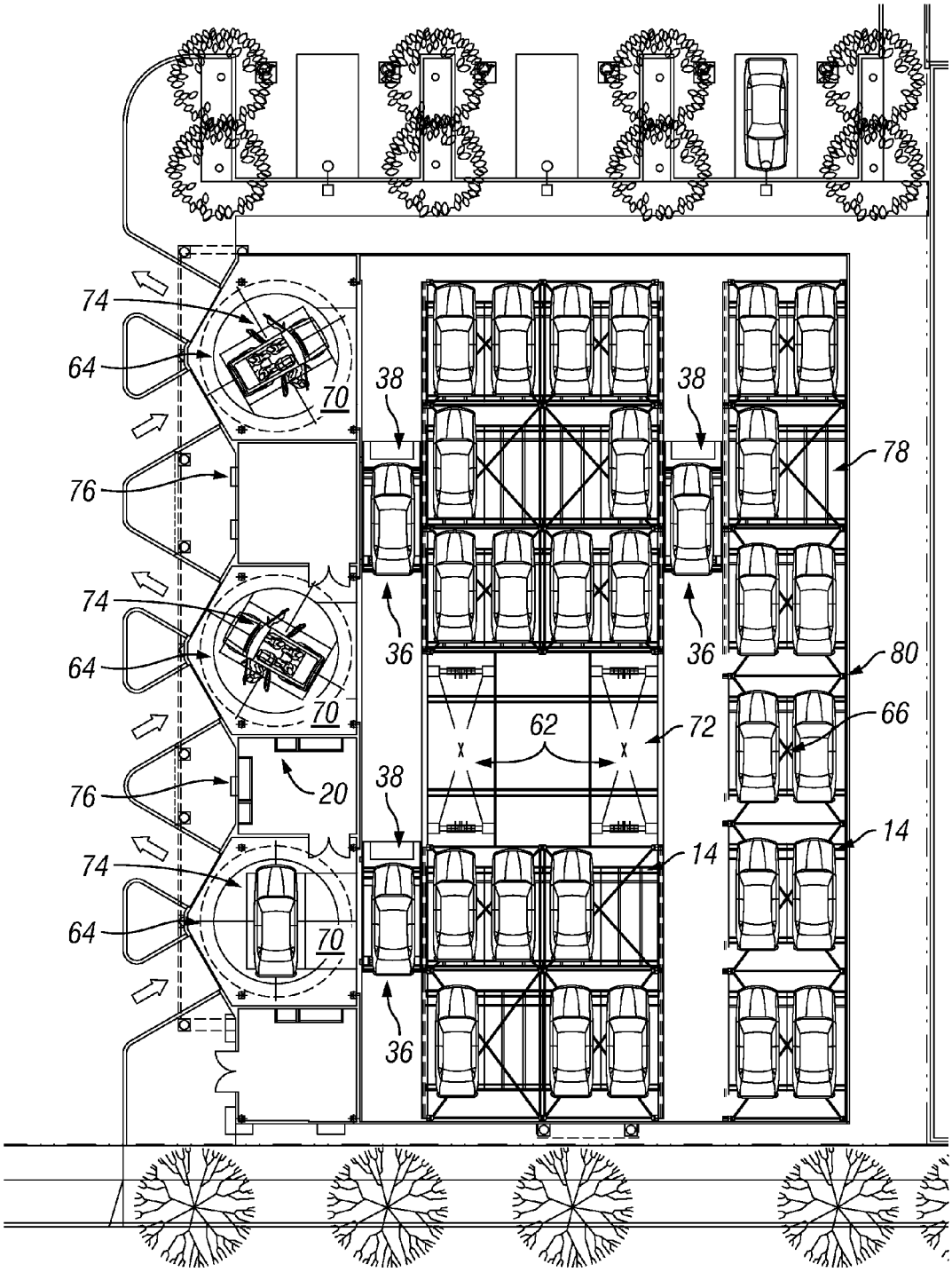
Figure 2D:
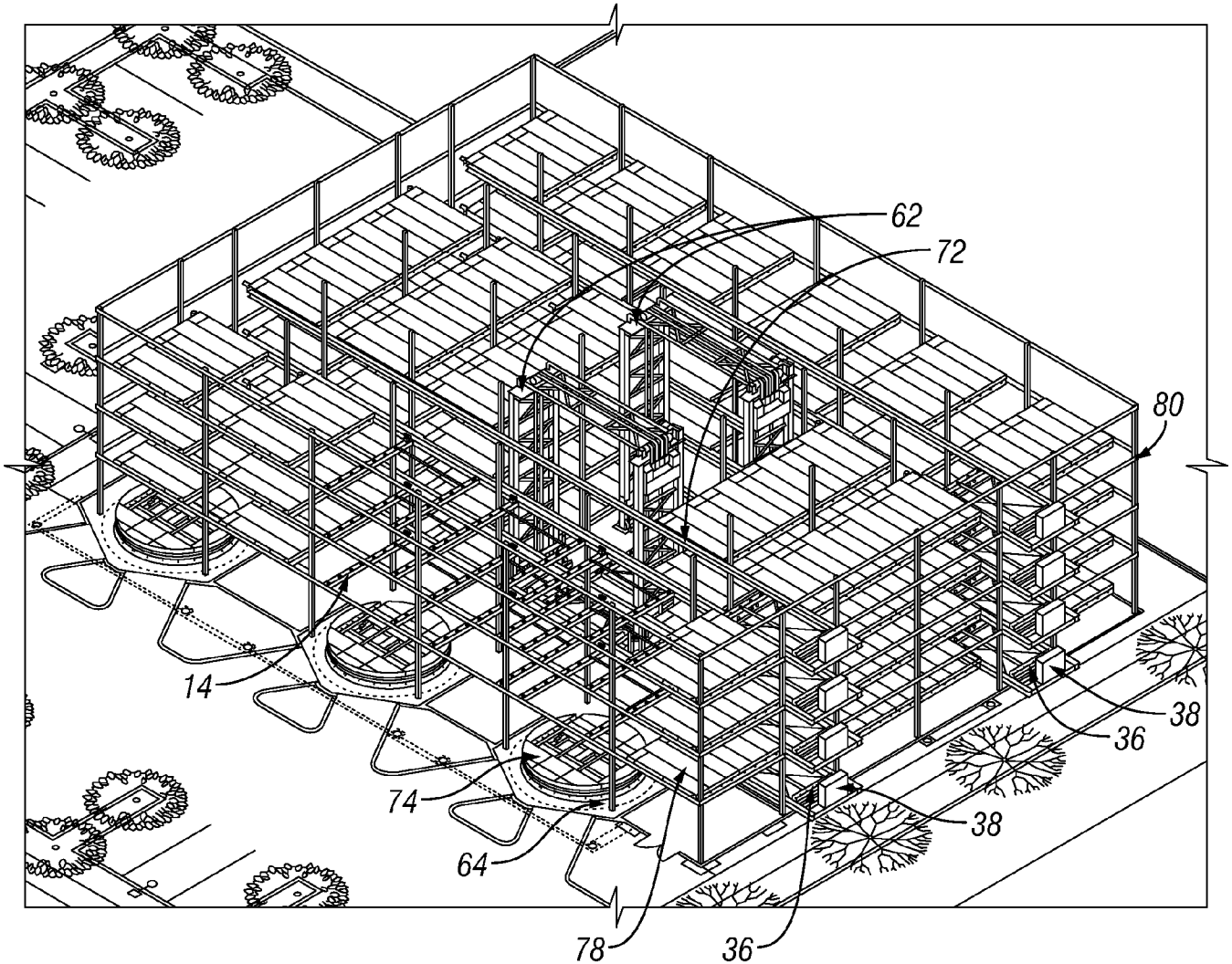
Figure 5:
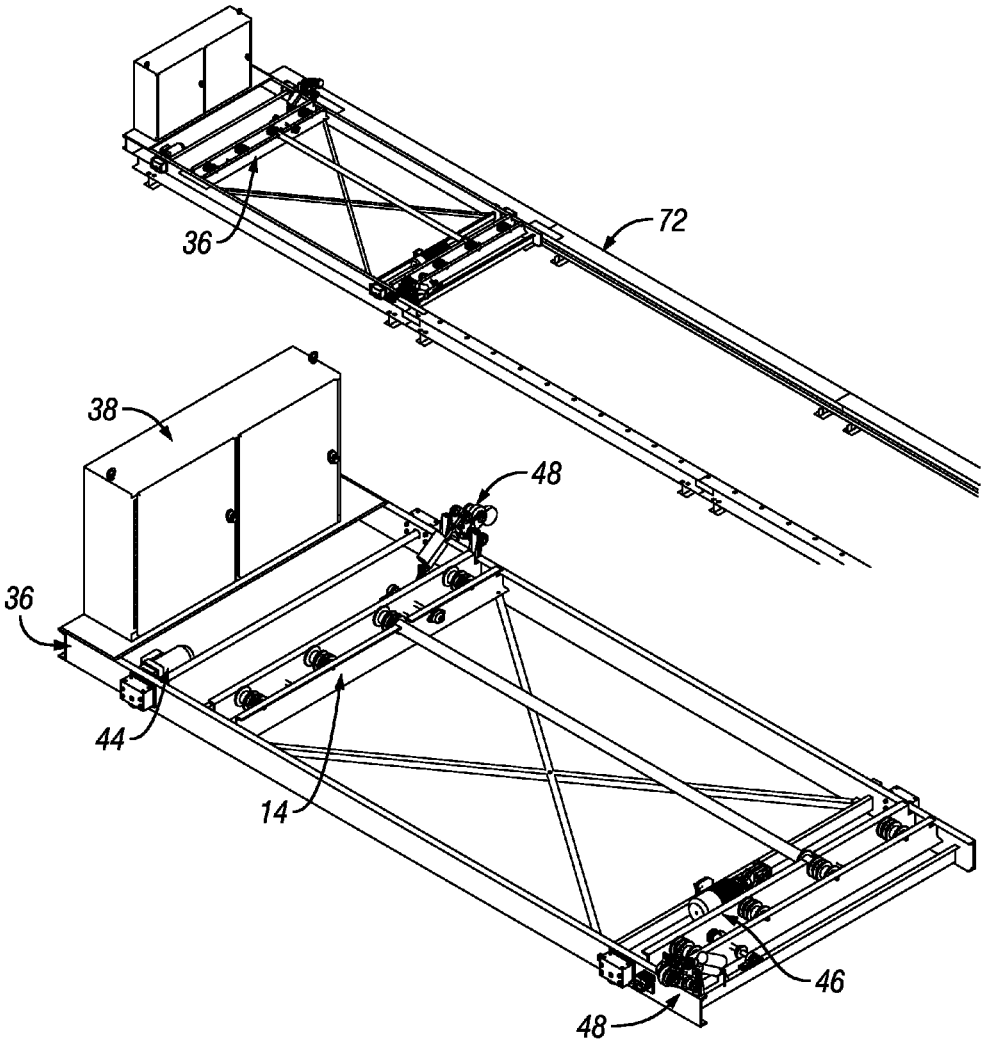
FIG. 5 illustrates a shuttle in the automated parking system that transfers vehicles horizontally through the automated parking system.
Figure 5:
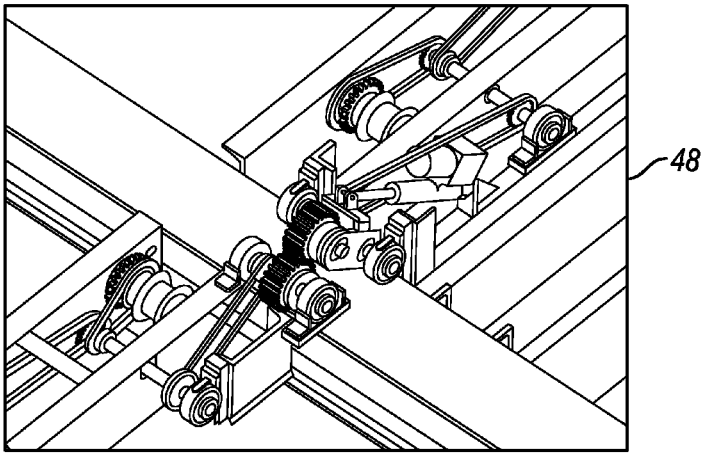
Figure 28:
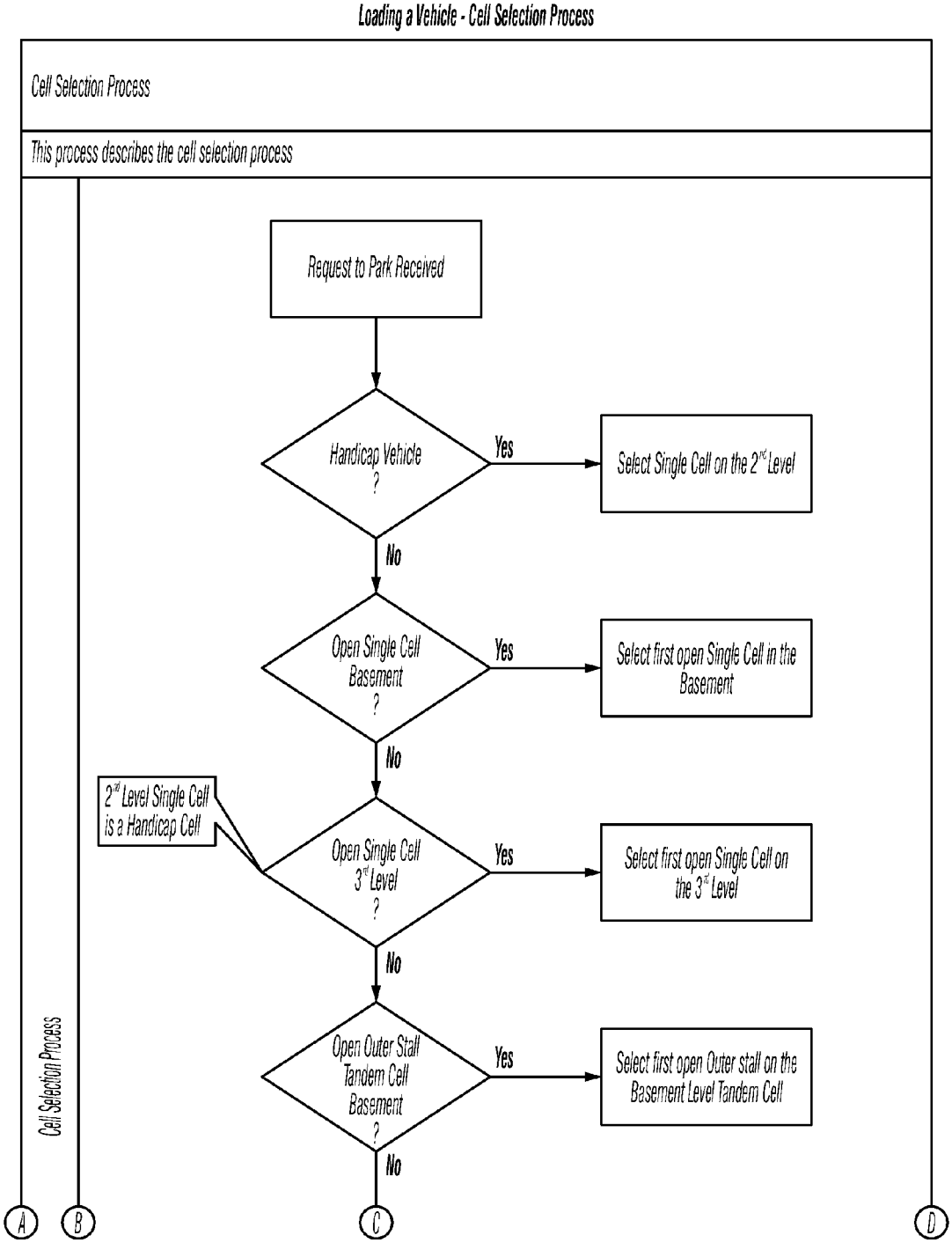
FIG. 28 is a flow chart illustrating an embodiment of a cell selection process.
Figure 28:
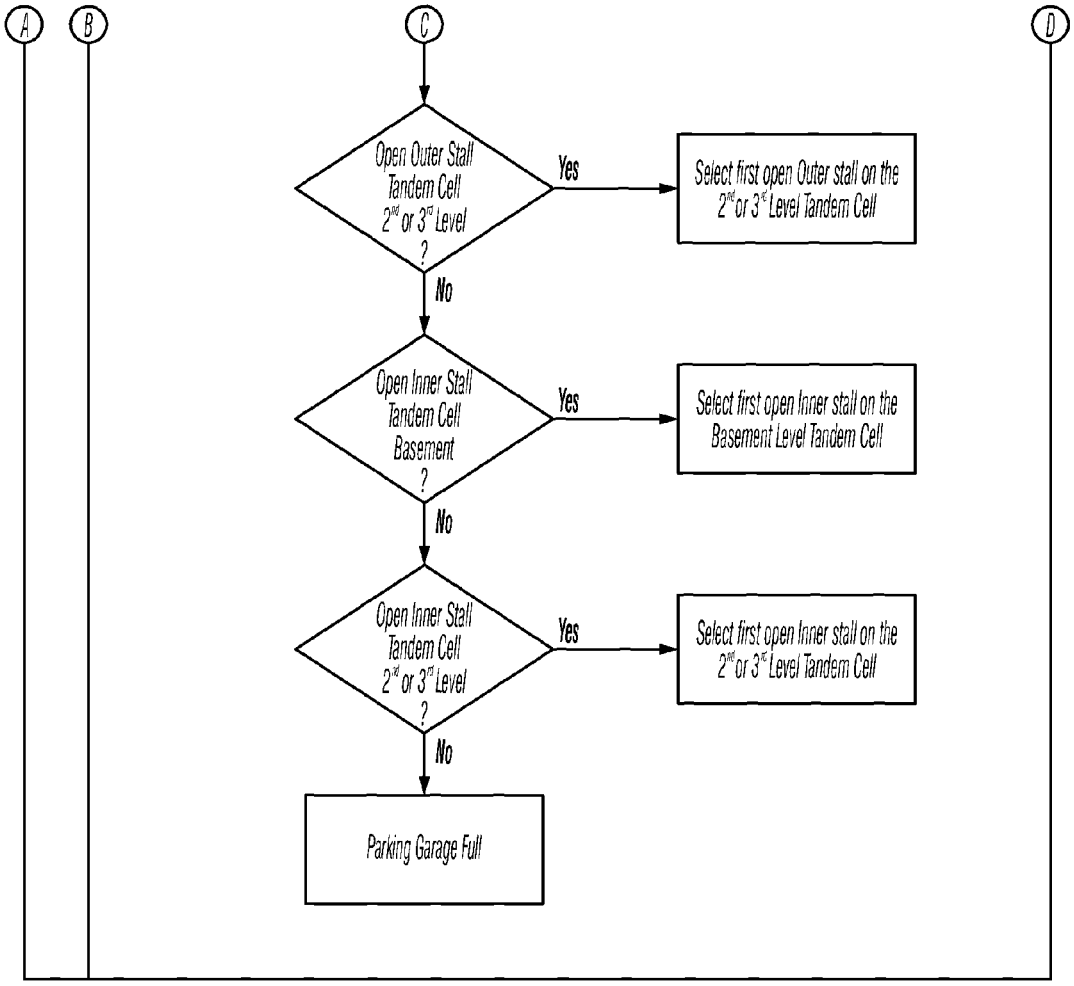

As illustrated in FIGS. 2*c* and 5, a shuttle 36 in the automated parking system 10 can be designed to transfer vehicles horizontally through the automated parking system 10. The shuttle 36 moves the vehicle forward or backward to a specific storage rack (cell 66). FIG. 28 is a flow chart illustrating an embodiment of a cell selection process. A series of proximity switches and other sensors 70 can be required throughout the rack structure 80 to verify shuttle 36 location and alignment at each cell 66. The shuttle 36 uses a radio frequency identification device (RFID) system 54 to store data about the vehicle at each cell 66.

A shuttle 36 can be provided that moves the vehicle horizontally from the lift 62 to an empty cell 66, for storage, and from that cell 66 back to the lift 62 for departure. The shuttle 36 then can get a vehicle from the cell 66 and deliver the vehicle to another cell 66. When tandem cells 66 are used, it may be necessary to move the outer vehicle to access the inner vehicle. In these situations, the vehicle parked in the outer cell 66 can be removed and transferred into an open cell 66 or buffer cell before the vehicle in the inner cell 66 can be retrieved.

Figure 6:
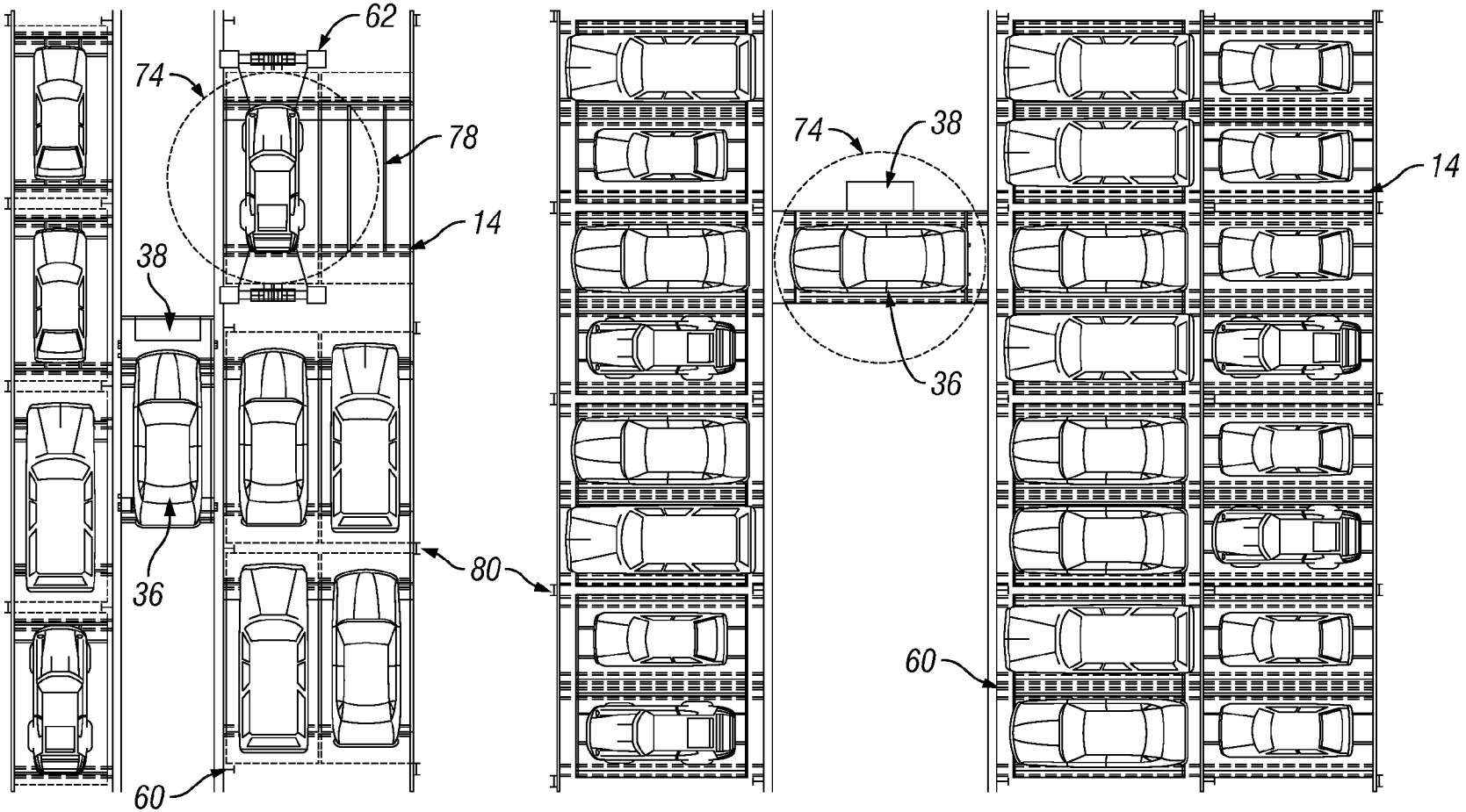
FIG. 6 illustrates an embodiment where a shuttle is designed for parallel orientation, perpendicular orientation or bi-directional orientation.

The shuttle 36 consists of a carriage that moves horizontally on powered rails 72. The shuttle 36 can be designed for parallel orientation, perpendicular orientation or bi-directional orientation as illustrated in FIG. 6. The shuttle 36 can also be designed to include a turntable on the shuttle 36 and can be designed to accept two vehicles on to one shuttle 36. Power can be delivered to the shuttle 36 via power rails and data are transferred to the shuttle 36 via a wireless Ethernet network. The shuttle 36 has motorized rollers to traverse the shuttle 36 along the shuttle rails 72. The shuttle 36 is equipped with a CDLR powered conveyor to move the vehicle on/off the shuttle 36 and into a cell 66 or on/off the lift 62. The shuttle 36 also has a parasitic drive 48 that will engage the parasitic cells 66 and drive the conveyor to transfer the vehicle off the shuttle 36 and into the parasitic cell 66.

Figure 7:
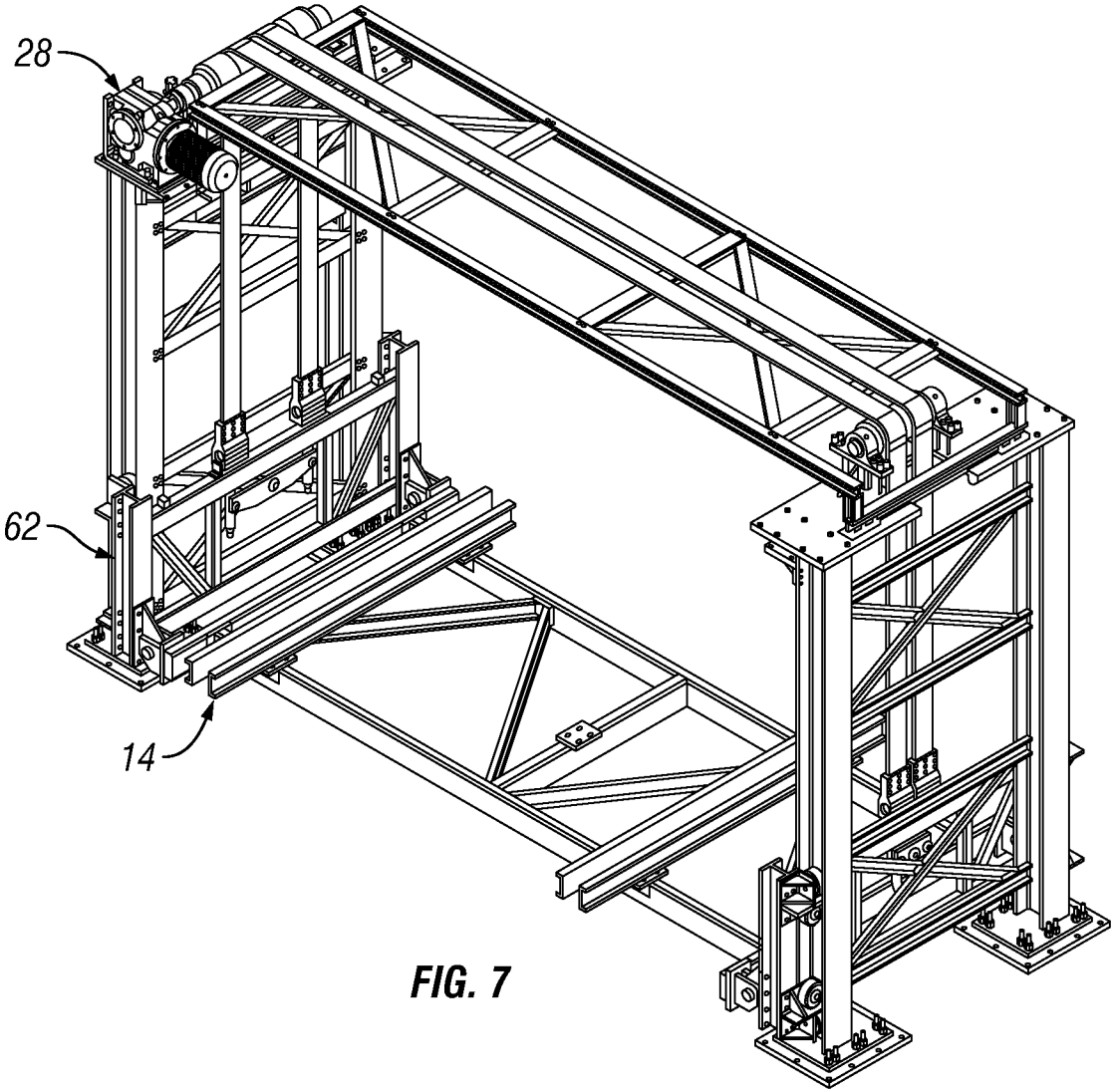
FIGS. 7 and 8 illustrate an embodiment of the present invention where a lift transfers vehicles vertically throughout the automated parking system.
Figure 8:
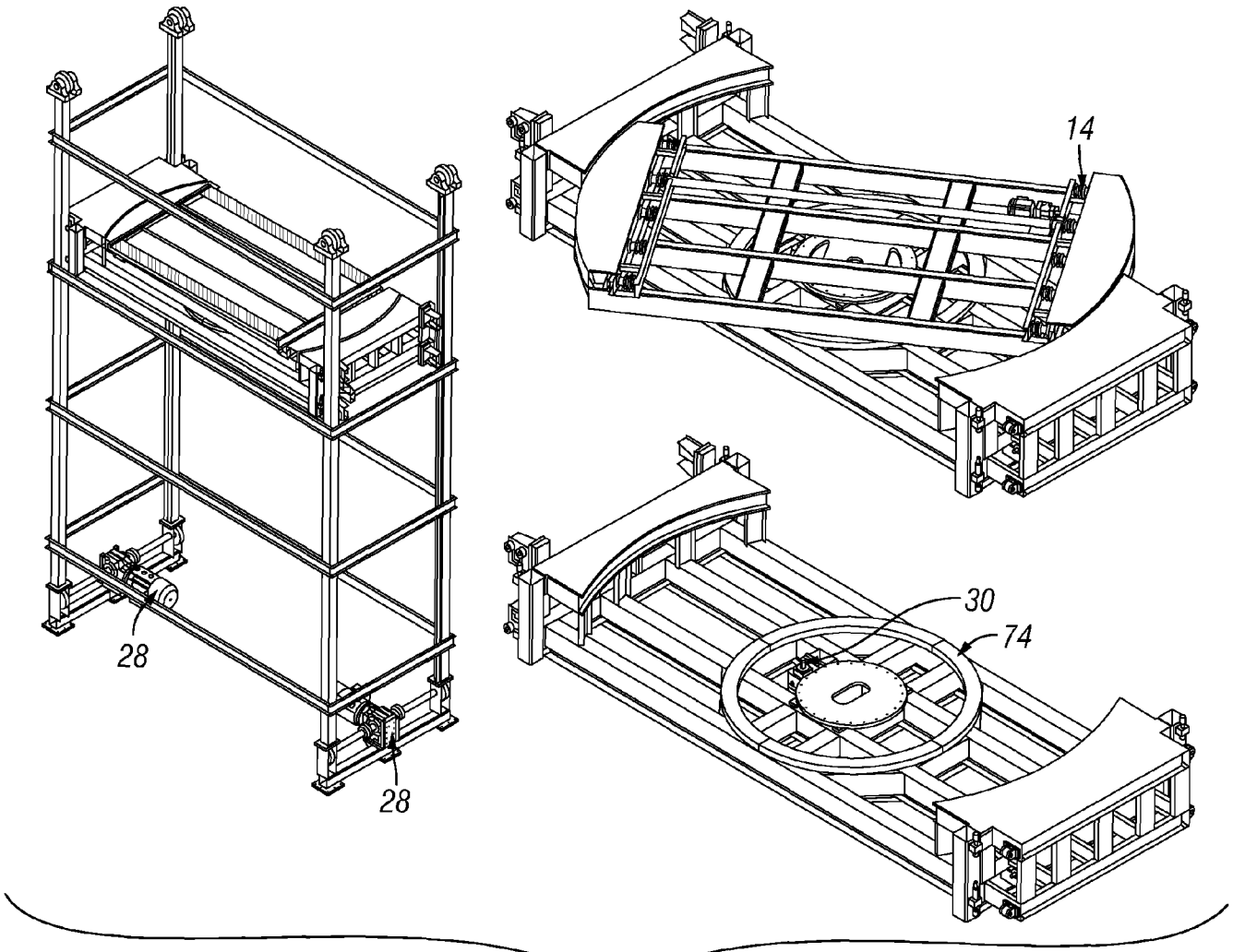

Referring to FIGS. 7 and 8, the lift 62 can be designed to transfer vehicles vertically throughout the automated parking system 10. A series of proximity switches and other sensors 70 can be required throughout the rack system to verify lift 62 location and alignment.

Figure 9:
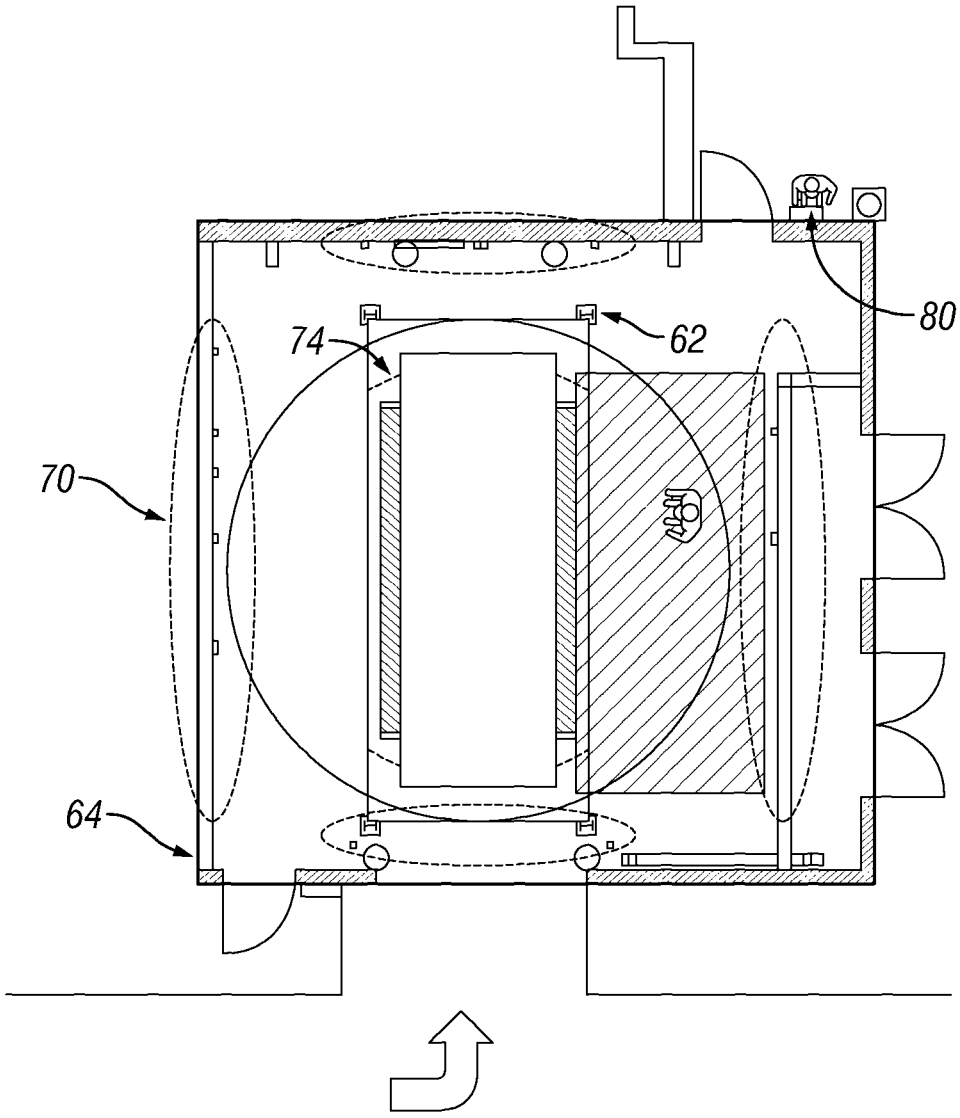
FIG. 9 illustrates an embodiment of the present invention with a loading bay that is the point of public interaction with the automated parking system.

As illustrated in FIGS. 2*c* and 9 the automated parking system 10 of the present invention includes a loading bay 64 which is the point of public interaction with the automated parking system 10. The automated parking system 10 accepts a vehicle and loads it into the system or retrieves a vehicle and returns it to the customer. The loading bay 64 isolates people (customers) from the automated parking system 10. Before a vehicle is automatically parked, the customer must have exited the loading bay 64 via a security door. The garage door must be closed, the security doors must be closed, and the vehicle must fit within the maximum size envelope for the vehicle. On departure, vehicles are returned by the automated parking system 10 to the loading bay 64. A turntable can be provided that rotates the vehicle, for example 180 degrees, so that the customer may drive the vehicle forward off the turntable when exiting the building (except for van accessible vehicle). This eliminates the need to back out of the system.

Figure 10:
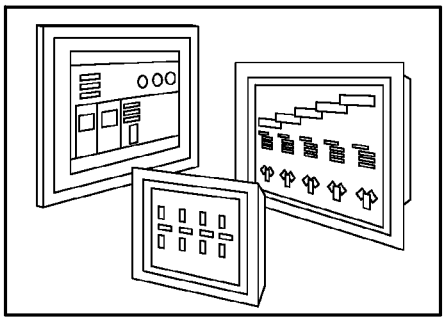
FIG. 10 illustrates an embodiment of the present invention with a loading bay equipped with a variety of sensors, access control, and a user interface.

The loading bay 64 can be equipped with a variety of sensors 70, access control, and human machine interface (user interface) devices 76, as shown in FIG. 10. A series of photoelectric laser sensors 70 can be used to measure the vehicle (width, height and length) to determine whether or not the vehicle will fit in the parking cell 66. Additionally, a variety of sensors 70 including ultrasonic displacement sensors 70 can be in place to guide a vehicle onto the center of the loading bay 64 and display notifications to a customer to pull forward, stop, and move right or left. Once the customer has left the loading bay 64 he will have to go to a user interface 76 to activate the automated parking system 10.

The storage rack/cells 66 can be located below grade, above grade, or partially below and above grade. The loading bay 64 can be located on any level of the storage rack. Vehicle loading can be achieved in the automated parking system 10 via: an on-grade system where the vehicle is transferred horizontally into the system, below grade where the vehicle can be lowered vertically into the system, or elevated where the vehicle raised vertically into the system. A Green/Red Light can be used to indicate whether the loading bay 64 is ready to accept a vehicle or the loading bay 64 is busy and cannot accept a new vehicle. In the operation of vehicle loading, the vehicle can be driven into the loading bay 64. A green light can be turned ON to indicate that the loading bay 64 is ready to accept a car.

A user interface 76 can be provided. User interface screens 76, menus, data labels, alarm and warning labels, and the like can be displayed in any desired language including but not limited to English. The user interface 76 can have the capability to integrate other languages when the need arises.

The user interface 76 access can be limited to car drop-off and retrieval (car pick-up) screens only. The user interface 76 can be the interaction between the automated parking system 10 and the customer. Password protected manual operation menus can be provided for maintenance personnel. Password protected demo screens can be provided for customer demonstration. The user interface 76 can be tied to pay stations, remote desktops, key fabs, Iphone applications, and similar.

The automated parking system 10 has a door that opens to allow the vehicle to be driven into the loading bay 64. Ultrasonic displacement sensors 70 and photoelectric laser sensors 70 can be in place to guide a vehicle onto the center of the loading bay 64 and determine wheel alignment. Display notifications are provided to a customer to pull forward, stop, and move right or left. Photoelectric laser sensors 70 measure the vehicle and determine the size of cell 66 to store the vehicle. The loading bay 64 can be also equipped with motion sensors 70 to detect if anyone is present in the loading bay 64 prior to operation of the parking system 10. The loading bay can be equipped with motion sensor 70 cameras that can detect movement inside the vehicle. These cameras can also be used to store photographs of the vehicle on the SCADA system to document the condition of the vehicle at loading and retrieval. After the customer parks the car in the loading bay 64 the customer goes to the user interface and initiates the parking process. After the parking process is initiated by the customer or attendant the vehicle can be rotated, for example 180 degrees. The vehicle can be transferred to the next section which can be a shuttle 36, lift 62 and the like, depending on the layout of the parking structure 12. After the vehicle is transferred to the next section, the loading bay 64 is ready to accept the next task such as accepting a new vehicle into the parking lot or receive a returning vehicle from the parking structure 12.

For vehicle return the customer returns to the user interface and initiates the vehicle return process. The vehicle can be returned to the loading bay 64 from either the shuttle 36 or the lift 62. A red light on the loading bay 64 indicates to incoming customers that the loading bay 64 is busy and cannot accept a new vehicle. When the shuttle 36 or lift 62 arrives at the loading bay 64, the vehicle is transferred to the loading bay 64. The parking garage door opens to allow the vehicle to exit the parking structure 12.

The parking cells 66 are designed as an open or closed steel framework with a series of CDLR conveyors 14 which hold pallets 78 that contain the vehicles, see FIG. 6. The CDLR conveyors 14 in the storage racks can be parasitically driven by the shuttle 36 to load and remove vehicles from the cells 66. The storage rack structure 80 supports the CDLR conveyors 14 and shuttle rails 72 which contain the power BUS for the shuttle 36. A BUS rail can be integrated into the support rails for the shuttle 36. The storage racks (cell 66) can be either single cell storage racks 66, tandem storage racks 66, triple storage racks 66 and the like.

Figure 13:
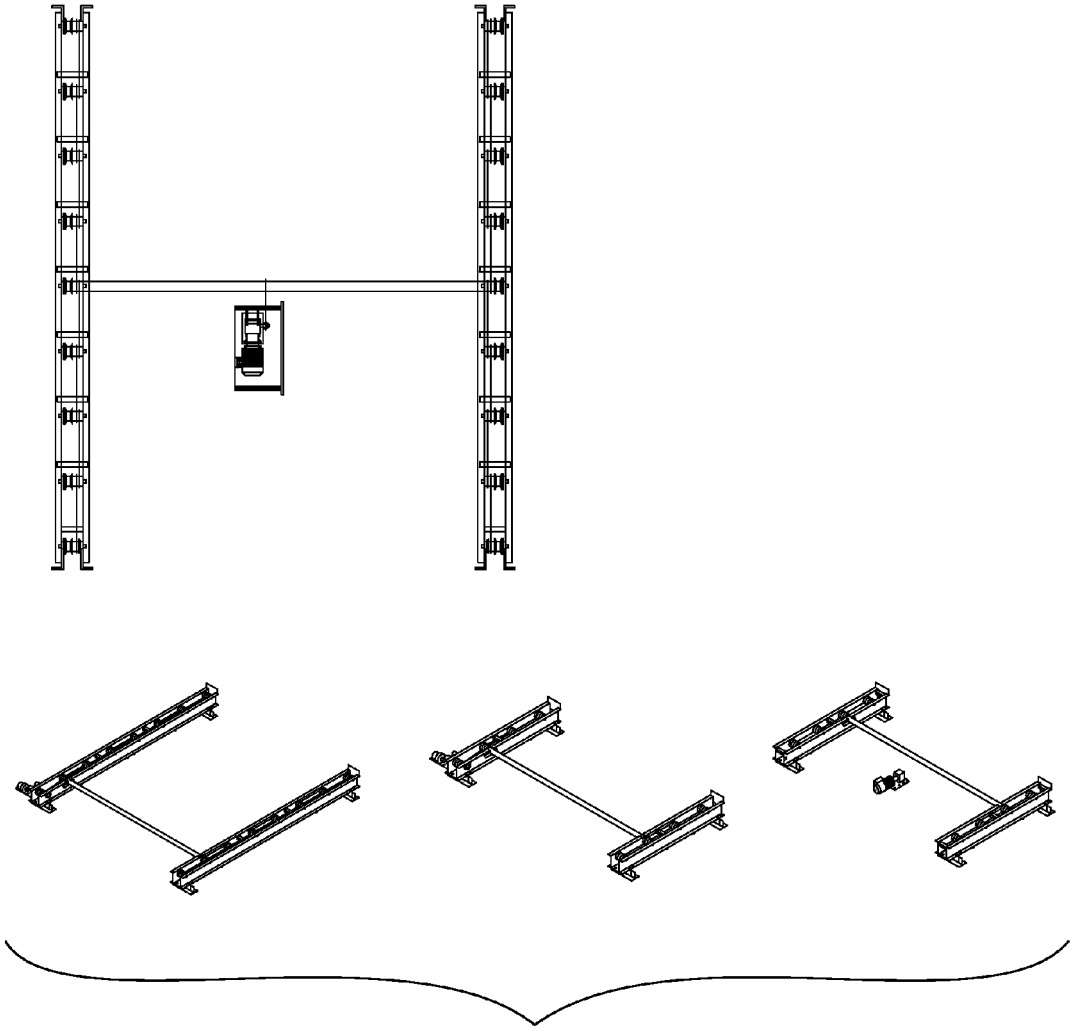
FIG. 13 illustrates an embodiment of the present invention where the powered CDLR conveyors in the parking cells are the same as the non-powered parasitic CDLR conveyors except that the conveyors are motorized.

Referring to FIG. 13, the powered CDLR conveyors in the parking cells 66 are the same as the non-powered parasitic CDLR conveyors except that the conveyors are motorized. The motorized conveyors can be used to transfer the vehicles from the lift 62 directly into the cells 66. The lifts, shuttles, and turntables can be equipped with a single powered conveyor. The powered parking cells can be either single cell storage racks or tandem parking cells 66.

Figure 26:
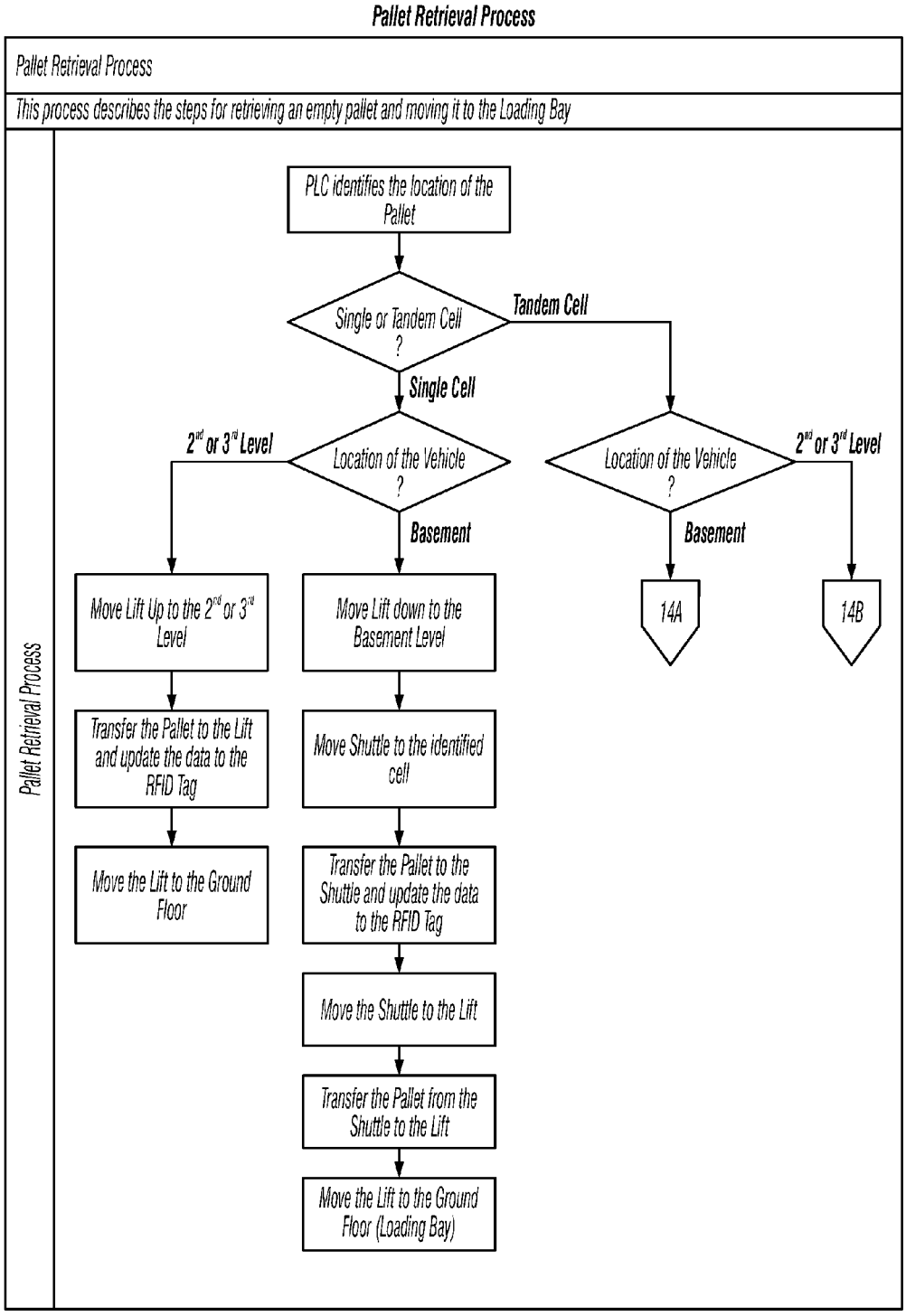
FIGS. 26 and 27 are flow charts that illustrate a pallet retrieval process.
Figure 27:
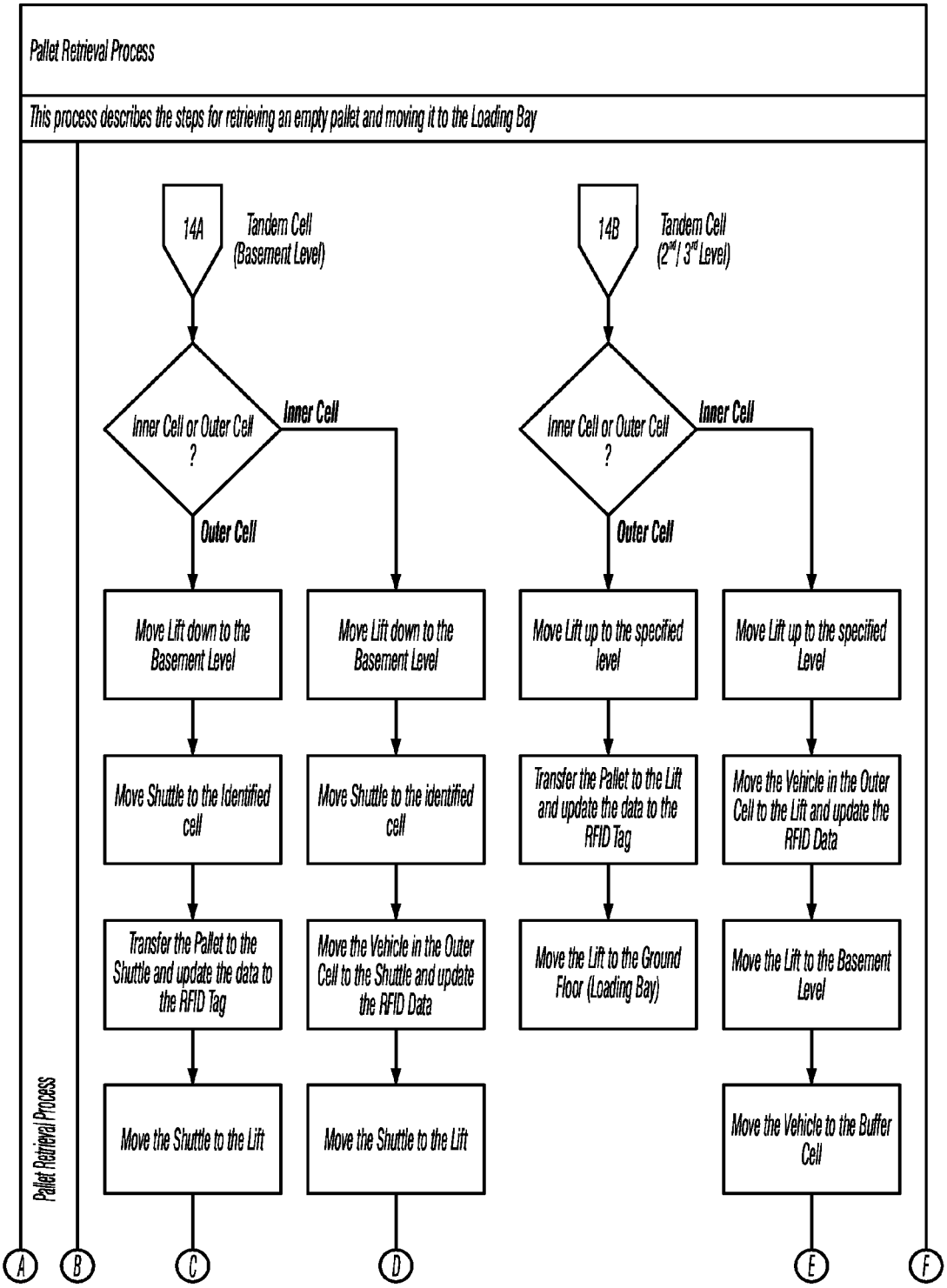
Figure 27:
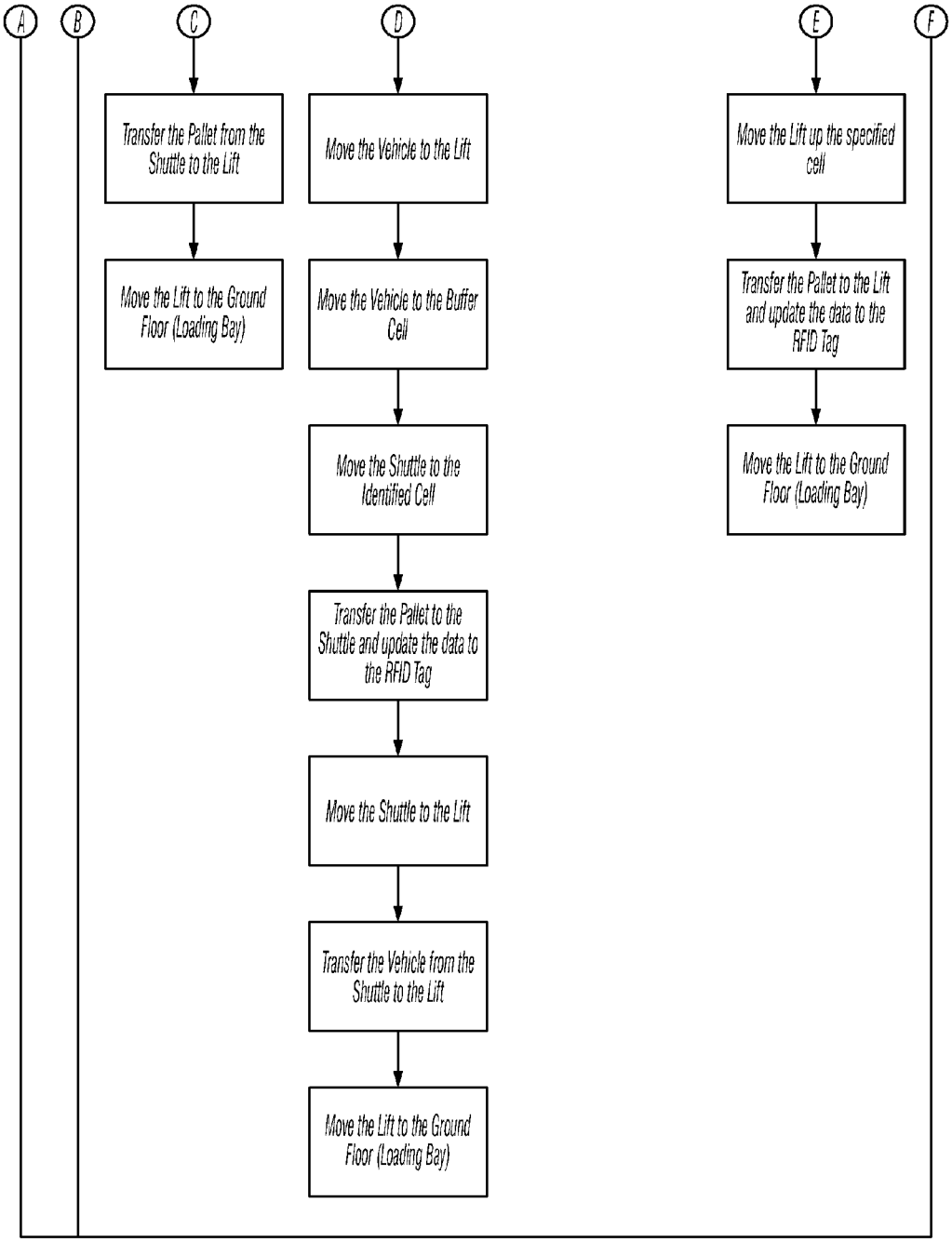

FIGS. 26 and 27 are flow charts that illustrate the pallet retrieval process.

A variety of cells 66 can be utilized including a single cell 66 for one vehicle, tandem cells 66 for two vehicles, and so on, as illustrated in FIG. 6, and as disclosed in the flow charts of FIGS. 14 thru 29. Removing a vehicle from the inner stall of a tandem cell 66 which can have inner and outer stalls. To retrieve vehicles from the inner stall of a tandem cell 66, the vehicle in the outer stall is moved to an open stall first before the vehicle can be removed from the inner stall. A buffer cell 66 can be available to temporarily hold a vehicle or pallet to allow the removal of a vehicle from the inner stall of a tandem cell 66. After the vehicle in the inner stall is removed and delivered to the loading bay 64 and received by the customer, the vehicle in the buffer cell 66 can be moved back into an open cell 66. In another embodiment a tandem shuttle can be used to remove the outer stall.

Powered cells 66 can be driven by a motorized powered CDLR conveyor 14. The system of the present invention can have parasitic cells 66 that are non-powered cells 66, as illustrated in FIGS. 1*b*,1*e*, 5 and 13. The conveyors on these parasitic cells 66 are powered by a parasitic drive on the shuttle 36. As a non-limiting example, there can be single and tandem cells 66, FIG. 6. Two vehicles can be parked on a tandem cell 66 by parking one at the front (outer cell 66) and one at the back (inner cell 66). Vehicles move from the shuttle 36 to the front (outer cell 66) of a tandem cell 66. As a second vehicle is loaded into a tandem cell 66, the front vehicle (outer vehicle) is transferred to the back (inner cell 66).

The powered storage rack receives a vehicle from the lift 62 and can have a motor driven conveyor to transfer a vehicle onto the lift 62. In one embodiment, a parasitic drive mechanism 48 is not on the lift 62. In one embodiment, the parasitic storage cell 66 does not have a motor. A conveyor can be operated from the shuttle 36 via a parasitic drive configuration FIG. 5.

A radio frequency identification tag (RFID) 68 can be attached to each cell 66. As a non-limiting example, a 16 Bit multi function intelligent flag controller can be installed in the lift 62 and shuttle 36. An RFID tag 68 can be used that contains data to flag whether a specific cell 66 can be occupied or empty. The RFID tag 68 can be used to indicate if a vehicle can be present in a specific cell 66. As the lift 62 stops at the cell 66, the intelligent flag unit can be given a trigger signal to READ Data. As a non-limiting example, data can be read from the RFID tag 68 and written to 8 discrete output bits which can be sent to the main control panel 18 to determine if there are any vehicles in the cell 66. When the lift 62 transfers a vehicle into the cell 66, an intelligent flag controller will trigger a WRITE command. As a non-limiting example, 8 bits via 8 discrete inputs can be written to the RFID tag 68.

The location of the vehicles within the automated parking system 10 can be stored in the main control panel 18 data memory area. A back up of the vehicle location data can be stored on an industrial PC. An RFID system 54 can provide an additional (redundant) method for vehicle location within the automated parking system 10. The RFID system 54 can be used to store the status of each cell 66. RFID tags 68 (memory devices) can be attached to each cell 66. The information stored on the RFID tag 68 identifies whether the cell 66 is completely empty, pallet, or vehicle is stored in that particular cell 66. The vehicle ID assigned to that vehicle when it was accepted into the automated parking system 10 can also be stored on the RFID tag 68. In the case of an emergency and data are lost, a tag data retrieve function will initiate a process where the shuttle 36 and lift 62 will move through the parking structure 12 and read the RFID tag 68 data. The data can be used to populate the main control panel data memory area so that the main control panel 18 knows which cells 66 are empty or have pallets or vehicles loaded in each cell 66.

The parasitic storage cells 66 do not need to have a control panel 18 or junction box. In one embodiment, the parasitic storage rack/cell 66 receives a vehicle from the shuttle 36 via a parasitic drive mechanism 48. An RFID tag 68 can be attached to each cell 66. In one embodiment, a 16 Bit Multi Function intelligent flag controller is installed in the shuttle 36. The RFID tag 68 can include data to flag whether a specific cell 66 is occupied or empty. The RFID tag 68 can be used to indicate if a vehicle is present in a specific cell 66.

As the shuttle 36 stops at the cell 66, the intelligent flag unit can be given a trigger signal to READ data. As a non-limiting example, data can be read from the RFID tag 68 and written to 8 discrete output bits which can be sent to the main control panel 18 to determine if there are any vehicles in the cell 66. When the shuttle 36 transfers a vehicle into the cell 66, the Intelligent Flag controller triggers a WRITE command. As a non-limiting example, 8 bits via 8 discrete inputs can be written to the RFID tag 68.

A separate user interface, industrial PC with touch screen running INDUSOFT SCADA (supervisory control and data acquisition) system can be used for all non-customer interaction including but not limited to, maintenance records, troubleshooting and diagnostics, backup of vehicle location data and the like. The INDUSOFT SCADA system can be PC based user interface software that interacts with the main control panel 18 to send and receive valuable data and also provide a gateway to remote connectivity, which can be as a non-limiting example through Ethernet. Maintenance access can be provided via a secured (password protected) screen menu.

Maintenance friendly diagnostic system can be provided to troubleshoot problems of the automated parking system 10 onsite or remotely including but not limited to, component usage, component monitoring, maintenance history alarm logging, and the like. Manual Operation of the automated parking system 10 permits a method to bypass sensor 70 failures to allow manual retrieval of parked cars or relocation of equipment for periodic maintenance.

Remote connectivity can be provided for offsite troubleshooting and offsite system monitoring. Remote connection to the automated parking system 10 allows for monitoring of the operation of the automated parking system 10 and access the various stored data from a remote location via an Ethernet, DSL, Satellite or similar connection. As a non-limiting example, a standard DSL line can be sufficient to retrieve data and monitor the automated parking system 10. As a non-limiting example, to access and retrieve camera and video images broadband cable modem or at least a 786K DSL line can be utilized.

In one embodiment, an RS-232 communications port is provided on the main control panel 18. An Ethernet port for remote connectivity can be included on the main control panel 18 as well as the Industrial PC running the indusoft SCADA program. The parking structure 12 may require a static IP address to utilize an ethernet port for remote connectivity.

The automated parking system 10 can operate with no operator/attendant involvement. Operation shall be safe from a user and environmental standpoint. This automated parking system 10 can be completely unattended. In order to effectively utilize the available space of the parking structure 12, the rack layout may be designed with a combination of different size parking cells 66 (compact, standard and oversized) as illustrated in FIG. 6. Cell 66 sizes are designed in both a horizontal foot print and a vertical foot print.

Figure 12:
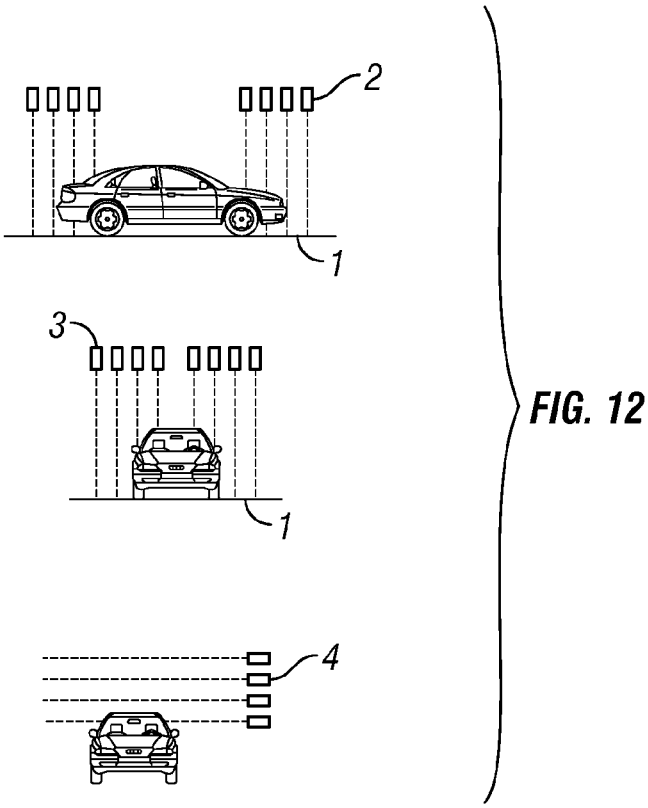

The loading bay 64 can have sensors 70 that can be able to measure the vehicle and determine which size cell 66 the vehicle should be stored in refer to FIG. 12. Multi-tasking of automated parking system 10 components (loading bay 64, lift 62, shuttle 36, and the like) is utilized to optimize throughput. The automated parking system 10 can have the ability to shutdown sections of the parking structure 12 (electrical power only) to allow emergency and maintenance access.

In the event of a power failure, an automatic re-start can be provided when power is restored. A power recovery sequence can include homing of all drives and automatic cell 66 data retrieval to verify location of all cars within the parking structure 12 Re-start can be based on last state before loss of power.

The automated parking system 10 can have emergency stop mechanisms designed to stop all physical movement of the equipment immediately. A safety network controller 40 can be provided by a separate safety network to disable moving parts in an emergency stop situation. In an emergency, total power need not be shut off to the system. Safety contactors can be placed between the various drives and motors to disable the motor in an emergency. The emergency stop mechanism(s) can be located in easily accessible areas around the equipment as required by national and local safety standards.

Alarms can take action via interlock(s) and/or predetermined procedural steps to shut the equipment down and notify the customer to contact the parking lot attendant or maintenance personnel. The attendant or maintenance personnel may be required to acknowledge the alarm before the alarm can be reset and the system restarted.

Warnings can be logged in an alarm log. A complete alarm list can be developed and included in the system design documentation.

The frequency of data collection can be based on change of state. The collection of data need not be time based. Data can be retrieved and stored only when something changes state. Lifetime and usage monitoring stores counter values. All lifetime limited components, as non-limiting examples, contactors, relays and the like, can be monitored using counters to count the number of times each of these components is activated.

Figure 29:
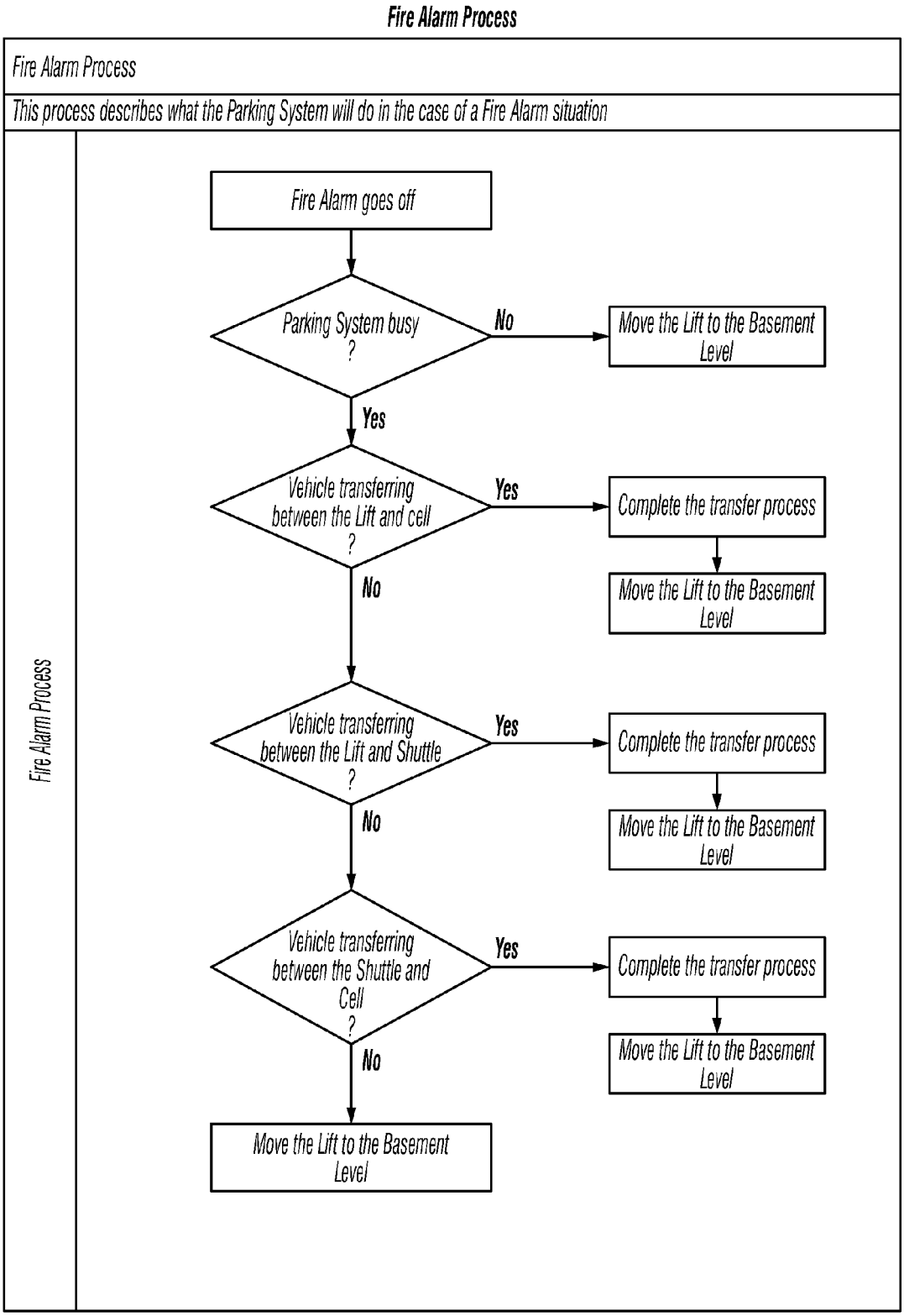
FIG. 29 is a flow chart illustrating a fire alarm process.

Alarms and warnings can include date and time stamp per occurrence. Data retention time on the system can include, counters (lifetime and usage monitoring) that, as a non-limiting example can be a maximum value of 99999999 with the option for counter value reset via maintenance screen. Alarm and Warnings can be, as a non-limiting example, the last 100 occurrences. Data can be stored in the main control panel 18 and in the industrial PC. Access to data for monitoring can be through a remote connection. FIG. 29 is a flow chart illustrating an embodiment of a firm alarm process.

In one embodiment, four levels of security are provided on the user interface. These levels are, (i) customer level—basic car drop-off and retrieval menus, (ii) maintenance level—customer level plus troubleshooting, manual operation, maintenance screens and alarm history, (iii) API leve—separate screens for client demonstration purpose and (iv) Engineer level—All screens including secured system setup menu.

Figure 11:
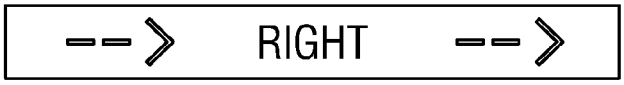
FIG. 11 illustrates an embodiment of the present invention where the customer drives the vehicle into a loading bay and positions it onto a turntable guided by a lighted directional sign.

In one embodiment, the ground level is used for the loading and unloading of vehicles into the building, as illustrated in FIGS. 2*c* and 9. The parking system 10 can be designed with as many loading bays 64 as required to meet the through put capacity required for the project. The loading bays 64 can be located at grade, below grade or elevated above grade and can be accessed from a parking lot, street, alley or ramp to a subterranean or elevated parking structure 12. The customer drives the vehicle into the loading bay 64 and positions it onto a turntable guided by a lighted directional sign, as illustrated in FIG. 11. When the loading bay 64 is clear of the customer the vehicle can be automatically parked by the automated parking system 10. On departure, the vehicle is returned to the loading bay 64 by the automated parking system 10. The customer drives the vehicle off the turntable to the exit of the building.

Figure 1B:
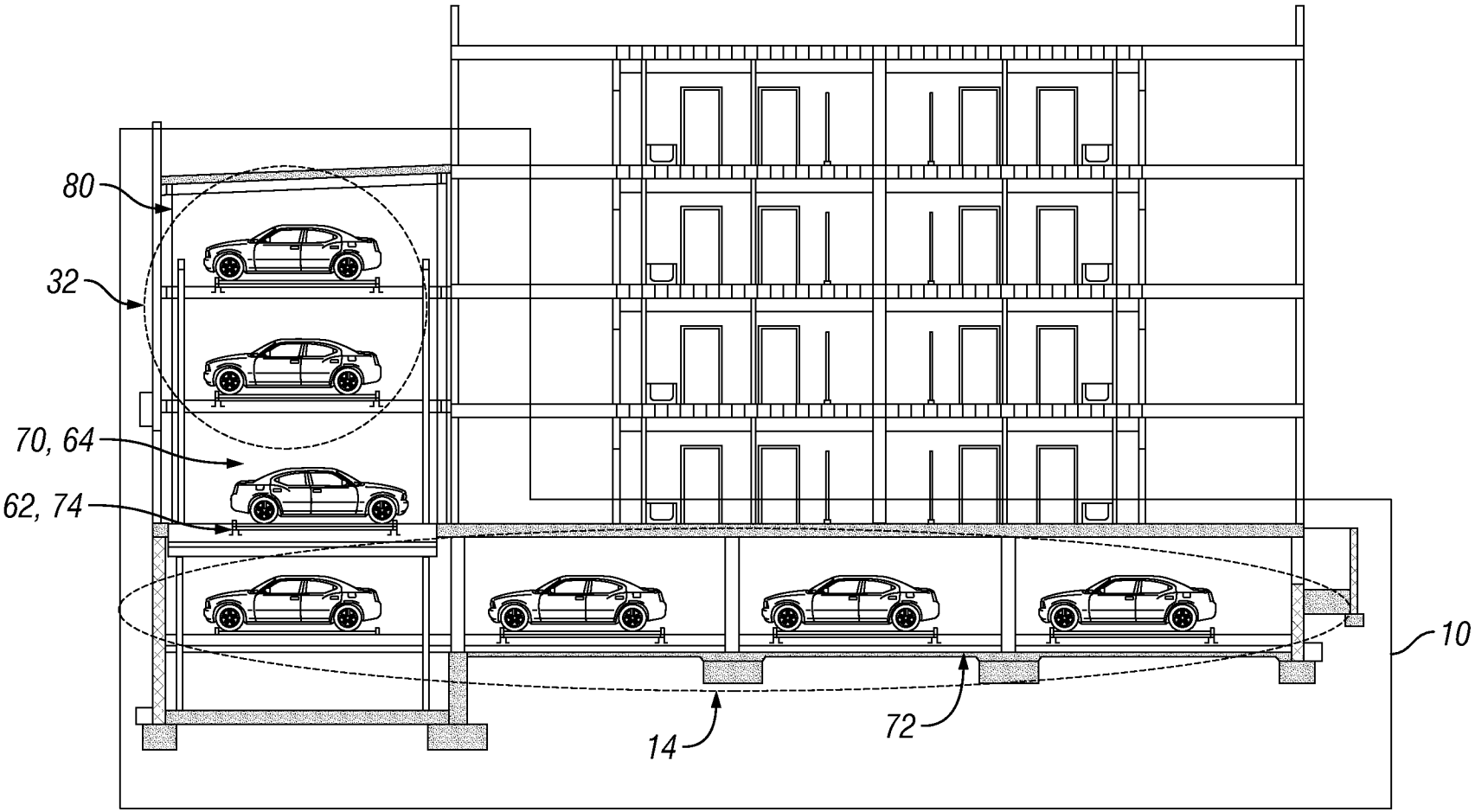
Figure 1C:
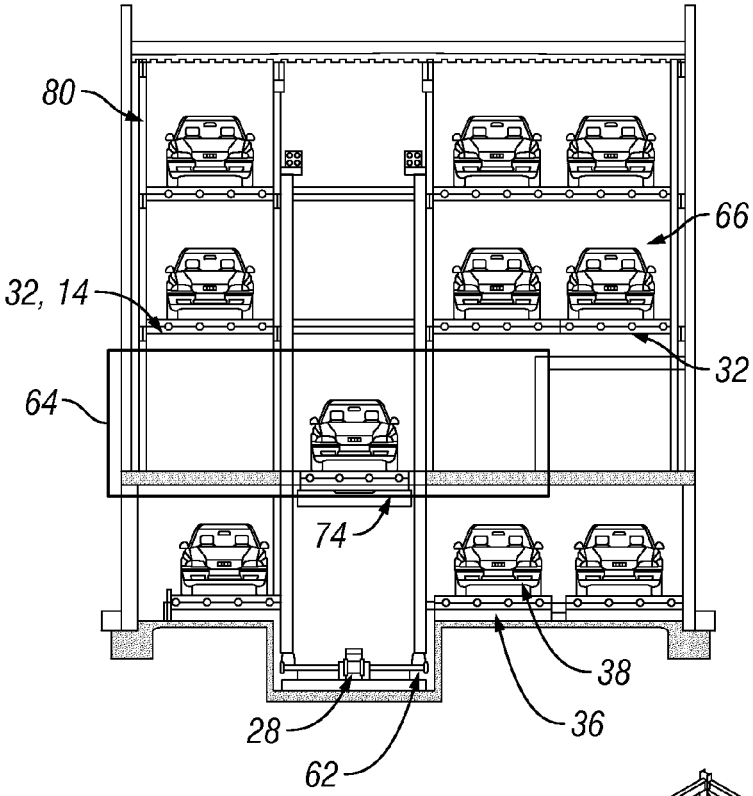
Figure 1D:
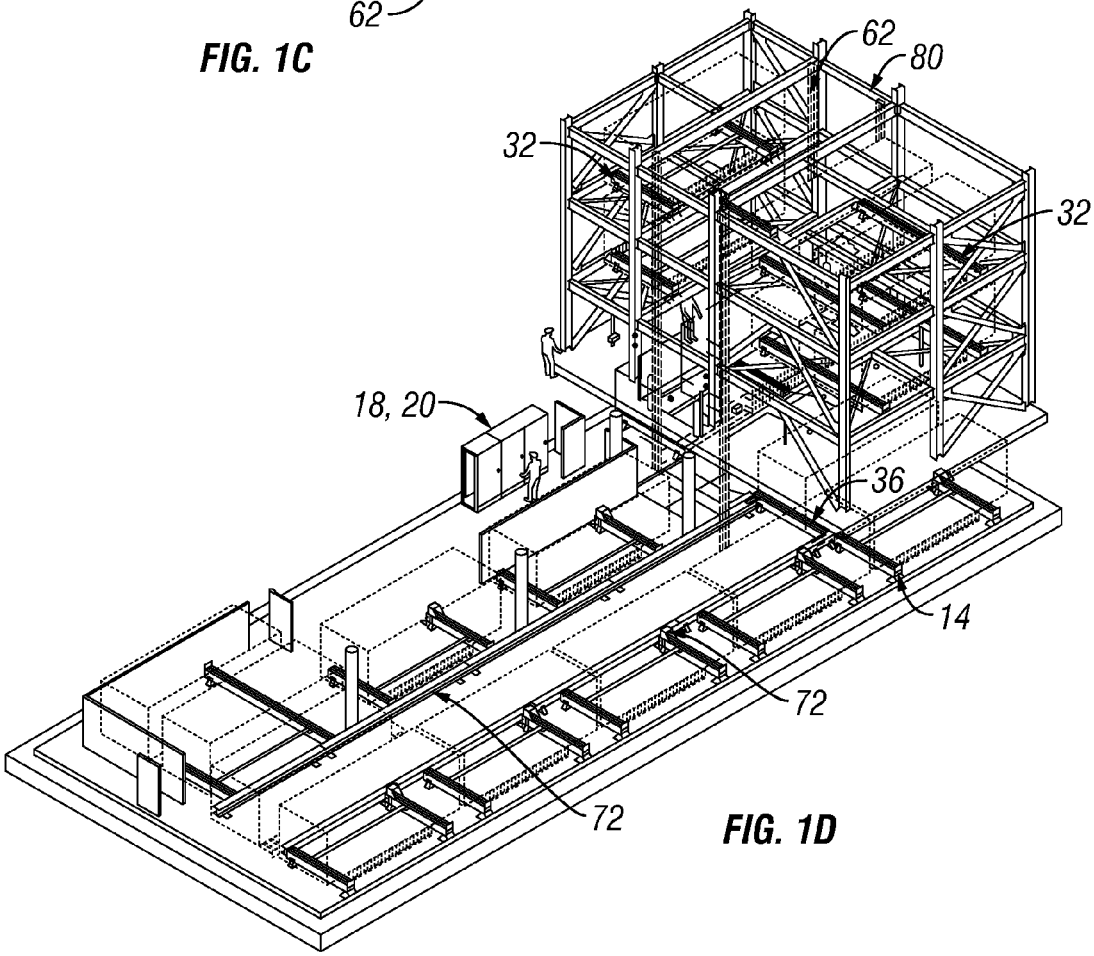

Two or more upper level parking areas can be in the structure, as illustrated in FIGS. 1*b* and 2*a*. It will be appreciated that there is no limit on the number of parking levels that can be built. The automated parking system 10 can have other uses distributed through out the system on various levels. The lift 62 lowers and raises vehicles between the ground level loading bay 64 and the level 2 and 3 storage cells 66. The vehicle is moved from the lift 62 to an empty tandem cell 66 or an empty single cell 66 for storage, and from that cell 66 back to the lift 62. To retrieve the inner vehicle on a tandem cell 66, the front vehicle must be moved first. A buffer cell 66 can be used for the temporary storage of the front vehicle while the back vehicle is moved to the loading bay 64 for departure. The upper levels can be accessed by multiple lifts 62 servicing multiple shuttles 36 on each level with an endless number of parking cells 66 available.

Figure 1E:
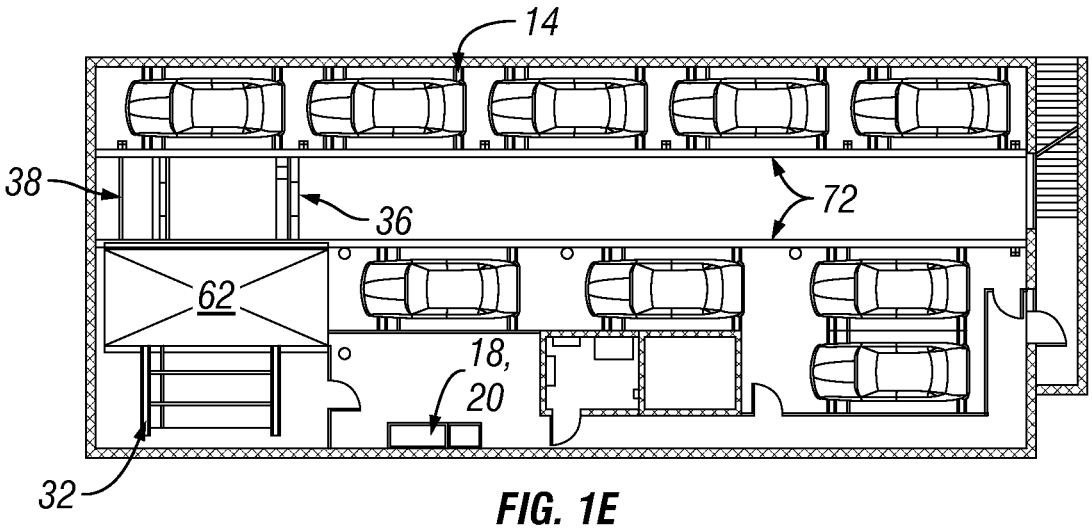
Figure 1F:
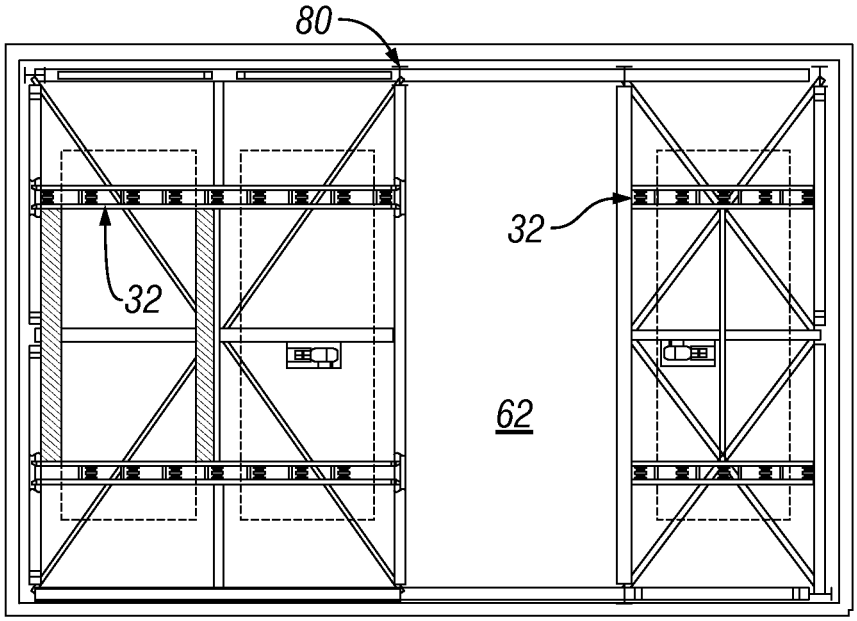

The parking structure 12 can have one or more subterranean levels (basement levels) and can be as tall or deep as a project requires. In one embodiment, the subterranean level can be for parking vehicles. The lift 62 lowers and raises vehicles between the ground level loading bay 64 and the basement level. The lift 62 transfers the vehicle to a shuttle 36. The shuttle 36 moves the vehicle from the lift 62 to an empty tandem cell 66 or an empty single cell 66 for storage, and from that cell 66 back to the lift 62. To retrieve the inner vehicle on a tandem cell 66, the front vehicle must be moved first. The buffer cell 66 can be used for the temporary storage of the front vehicle while the back vehicle is moved to the loading bay 64 for departure, as illustrated in FIG. 1*e*.

As shown in FIG. 9, the customer can enter the automated parking system 10 from an alley behind the building. A green and red light can be used to notify the customer whether the automated parking system 10 is available or if it is busy. A green light to tell the customer that the automated parking system 10 is available and he can enter the building as soon as the garage door opens. A red light means that the automated parking system 10 is busy either loading another car or unloading another car. If the garage door opens, the customer should be aware that a car can be driving out of the building. As soon as the light turns green, the customer can be able to access the automated parking system 10. If an incoming customer and outgoing customer activate the system at the same time, the outgoing customer can be a higher priority and get serviced first.

When a customer drives up to the parking garage, a red or green light can be on indicating whether or not the automated parking system 10 is busy or ready. If the green light is ON, the customer can be able to activate the automated parking system 10 using a remote transmitter. The garage door will open and allow the customer to drive his vehicle into the automated parking system 10.

As soon as the garage door is open, the customer slowly and carefully drives his vehicle into the automated parking system 10. Several ultrasonic measurement sensors 70 will measure the position of the vehicle and provide feedback to the customer to guide him into the loading bay 64 as illustrated in FIG. 9.

A large LED message board, FIG. 11, guides the customer to position the vehicle correctly onto the loading bay 64 platform. The message board provides feedback to the customer by displaying various commands including "Right", "Left", "Forward", Back", "Stop" and the like.

In one embodiment, as soon as the customer parks the car in the loading bay 64, the customer exits the car and walk over to a user interface device 76. The user interface device 76 can be a touch screen interface device which the customer will use to identify himself, FIG. 10. At this time, if the vehicle is too big, or an object is protruding too far outside the space permitted envelope around the vehicle, or the customer is already occupying his permitted number of stalls, or if there are any other reasons that the car cannot be parked inside the parking structure 12, an alarm message will display asking the customer to remove the car from the parking garage. As soon as the customer is recognized by the automated parking system 10 and no alarms exist, the vehicle can be ready to load into the automated parking system 10.

As stated above, sensors 70 are used by the automated parking system 10 to determine the size of a vehicle. Only vehicles within set parameters can be automatically parked.

Referring now to FIG. 11, as vehicles are driven into the loading zone their length is measured. Sensors 70 in the front and sensors 70 in the rear, allow the automated parking system 10 to calculate the length of the vehicle. Vehicles are considered "too long" when they cannot fit within the sensors 70.

Referring to FIG. 11, as vehicles are driven into the loading zone their width is measured. Sensors 70 on the left and sensors 70 on the right allow the automated parking system 10 to calculate the width of the vehicle. Vehicles are considered too wide when they can not fit within the sensors 70.

Figure 18:
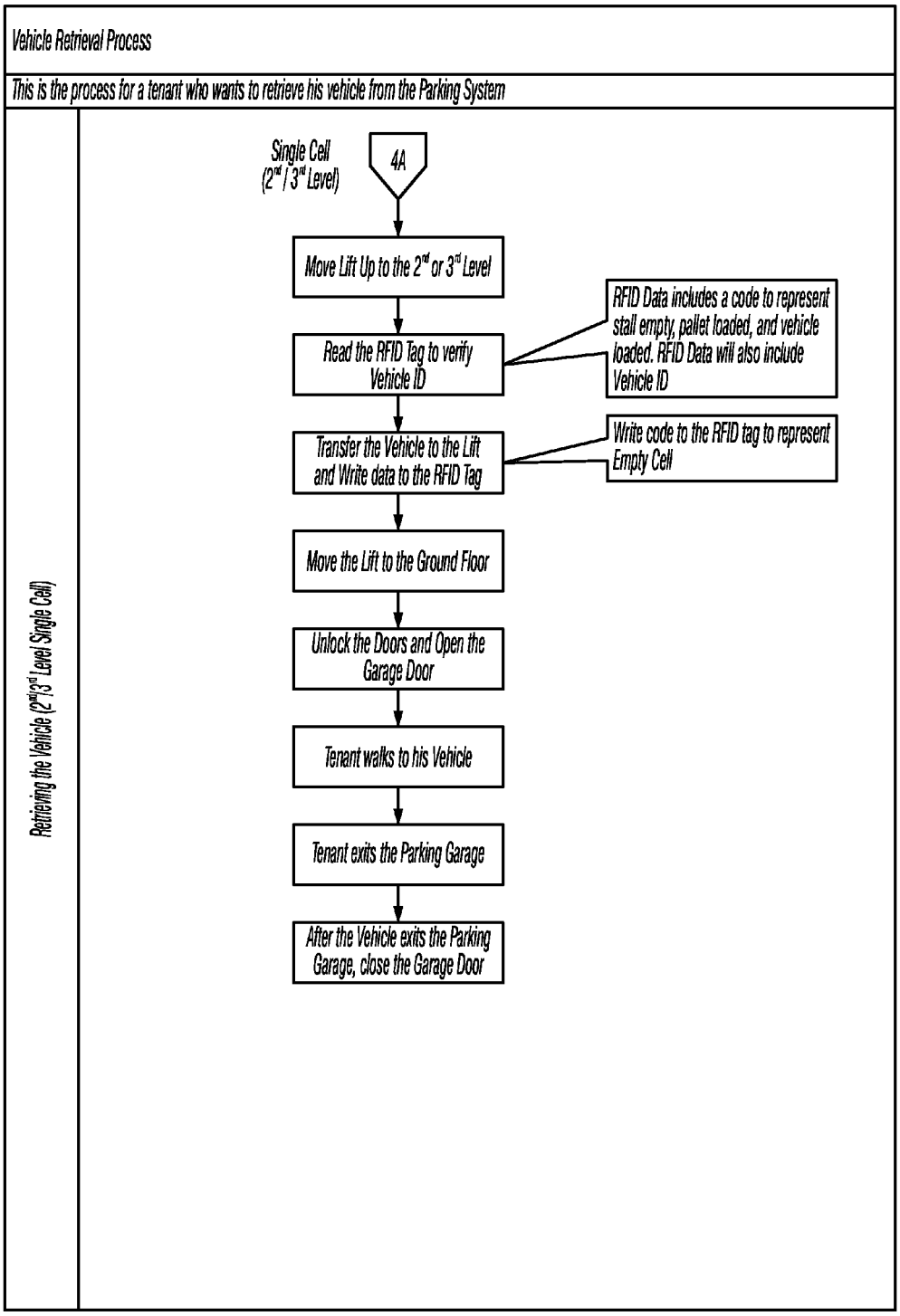
Figure 19:
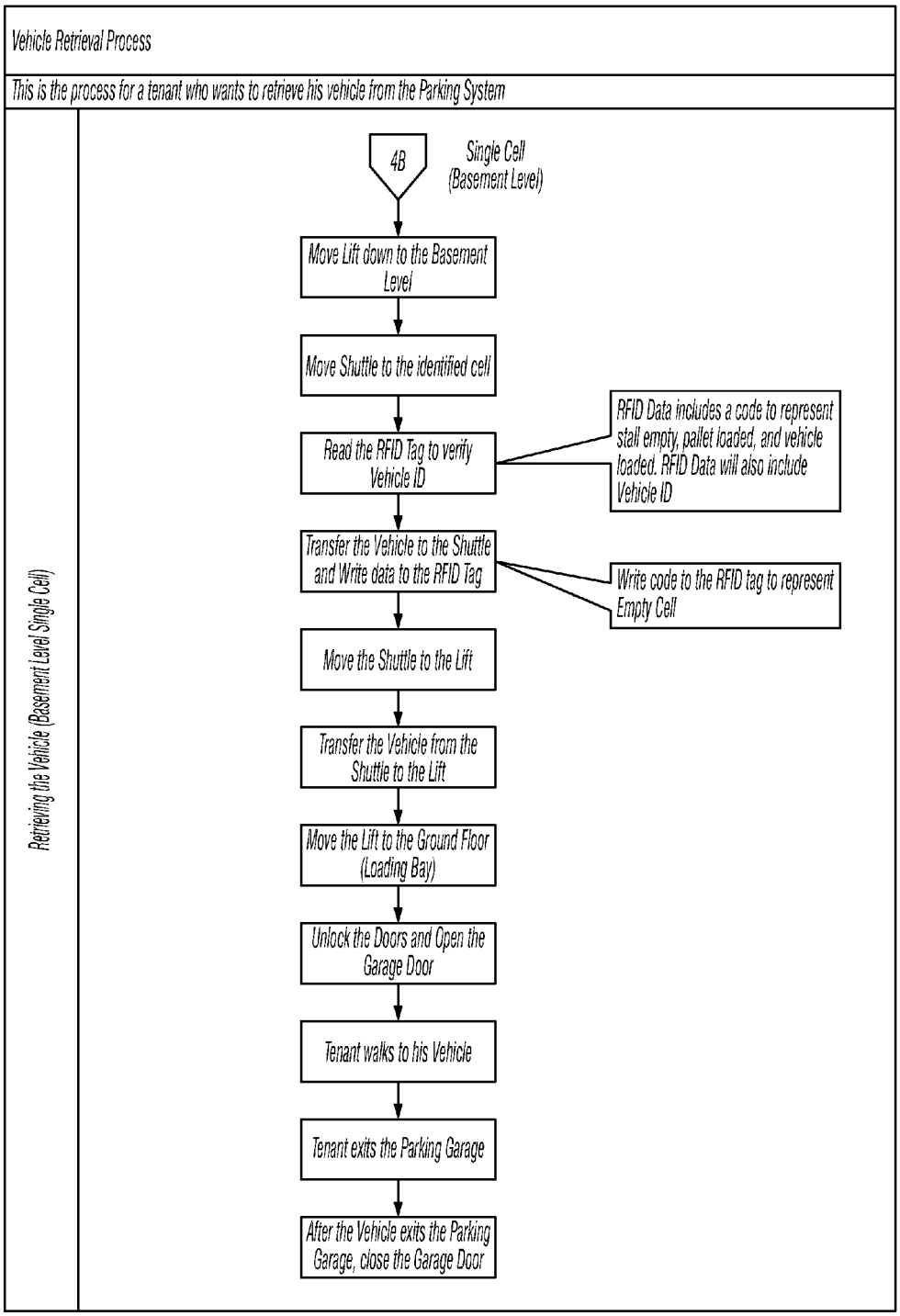
Figure 20:
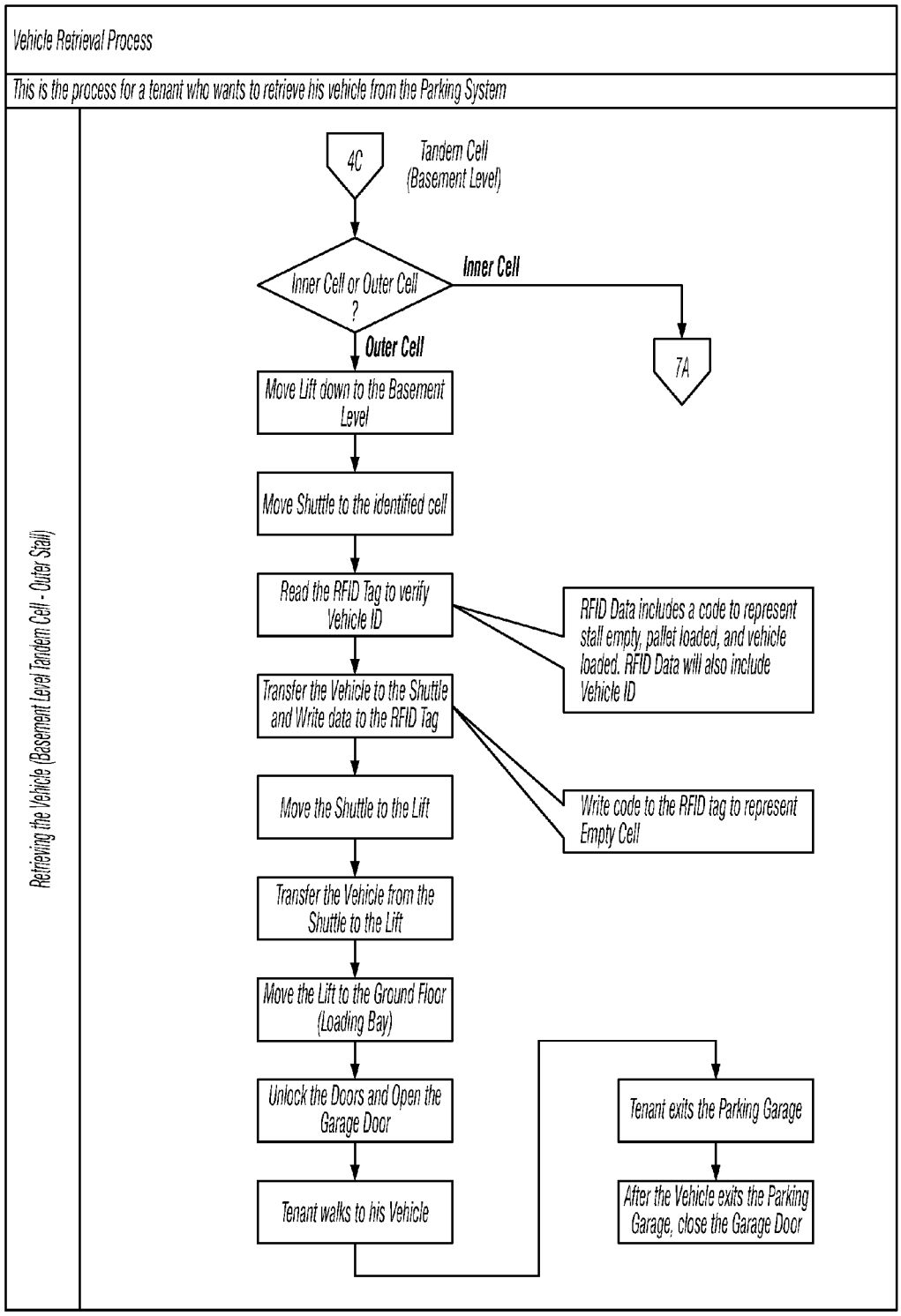
Figure 21:
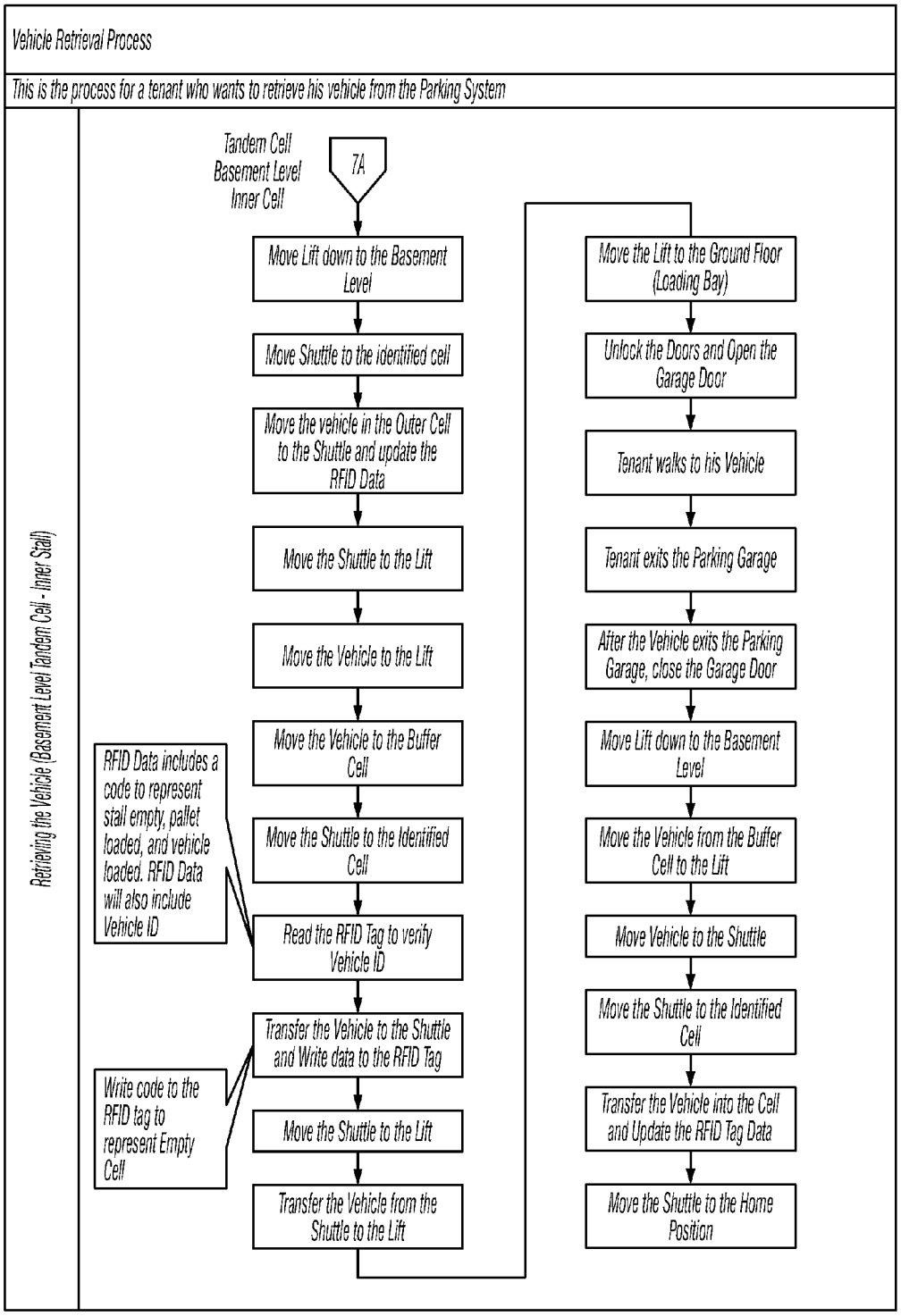
Figure 22:
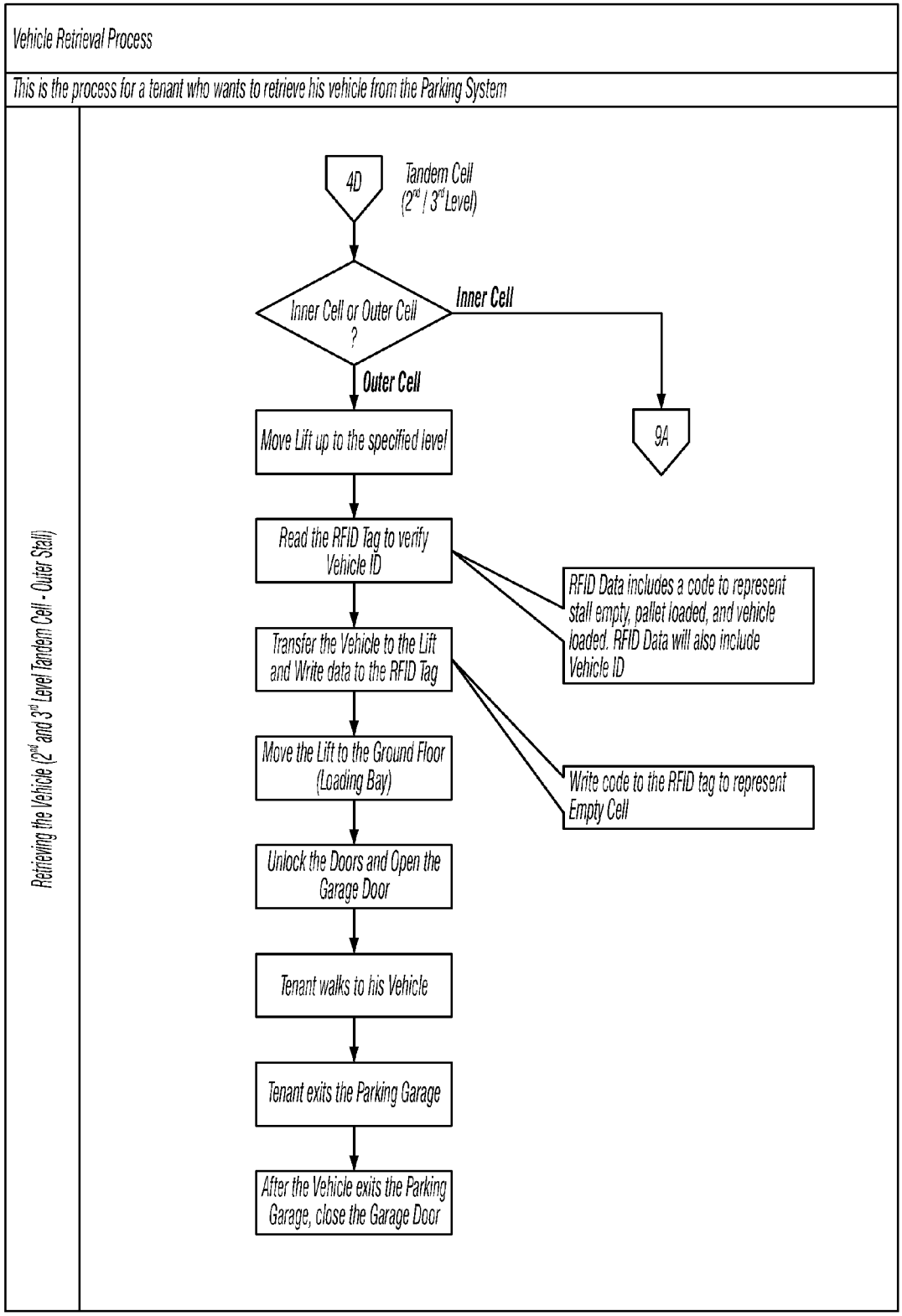
Figure 23:
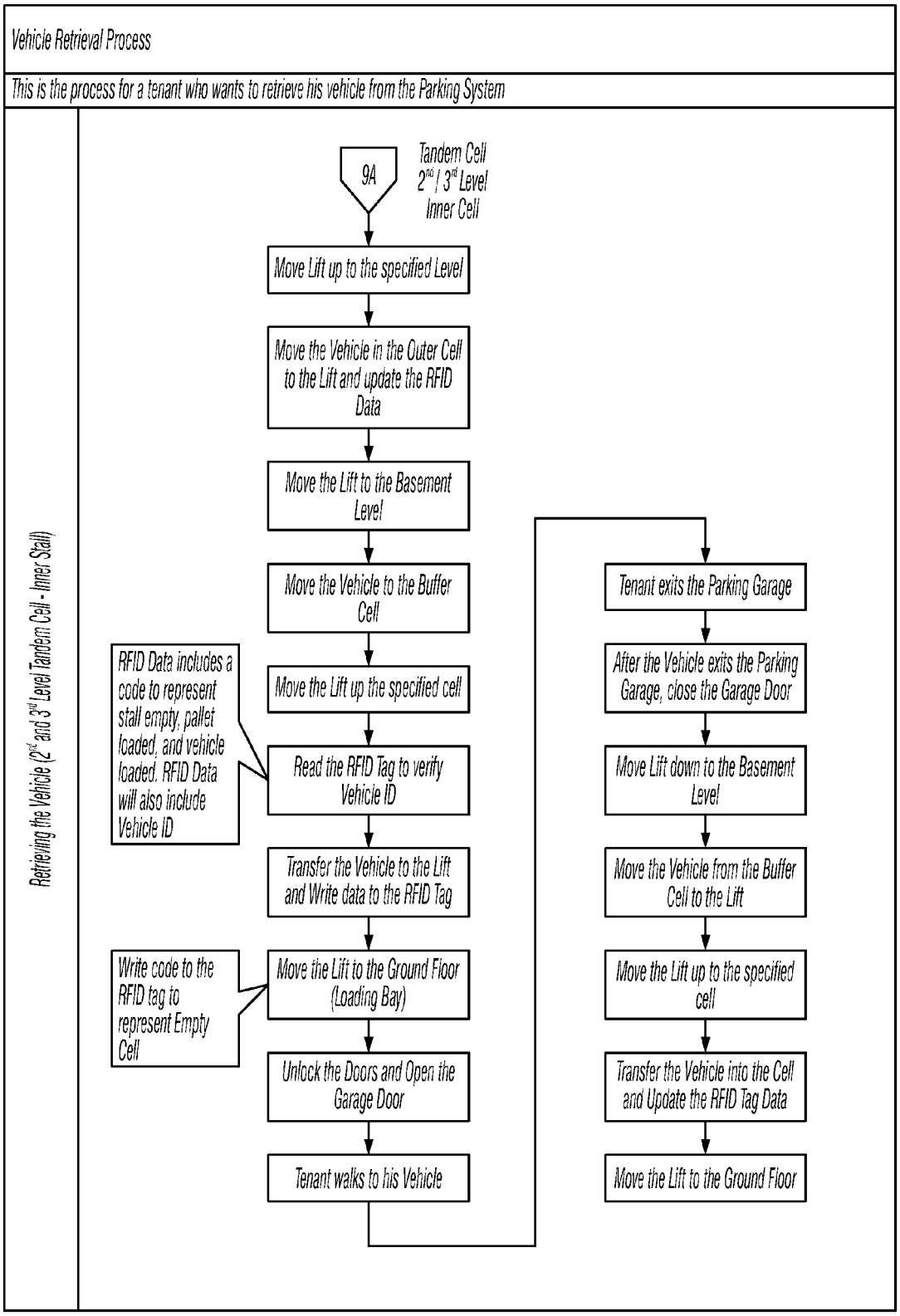

As vehicles are driven into the loading zone their height is monitored, FIG. 18. Vehicles are measured "too high" when they can not fit under the array height sensors 70. All cells 66 need not be the same height.

Figure 14:
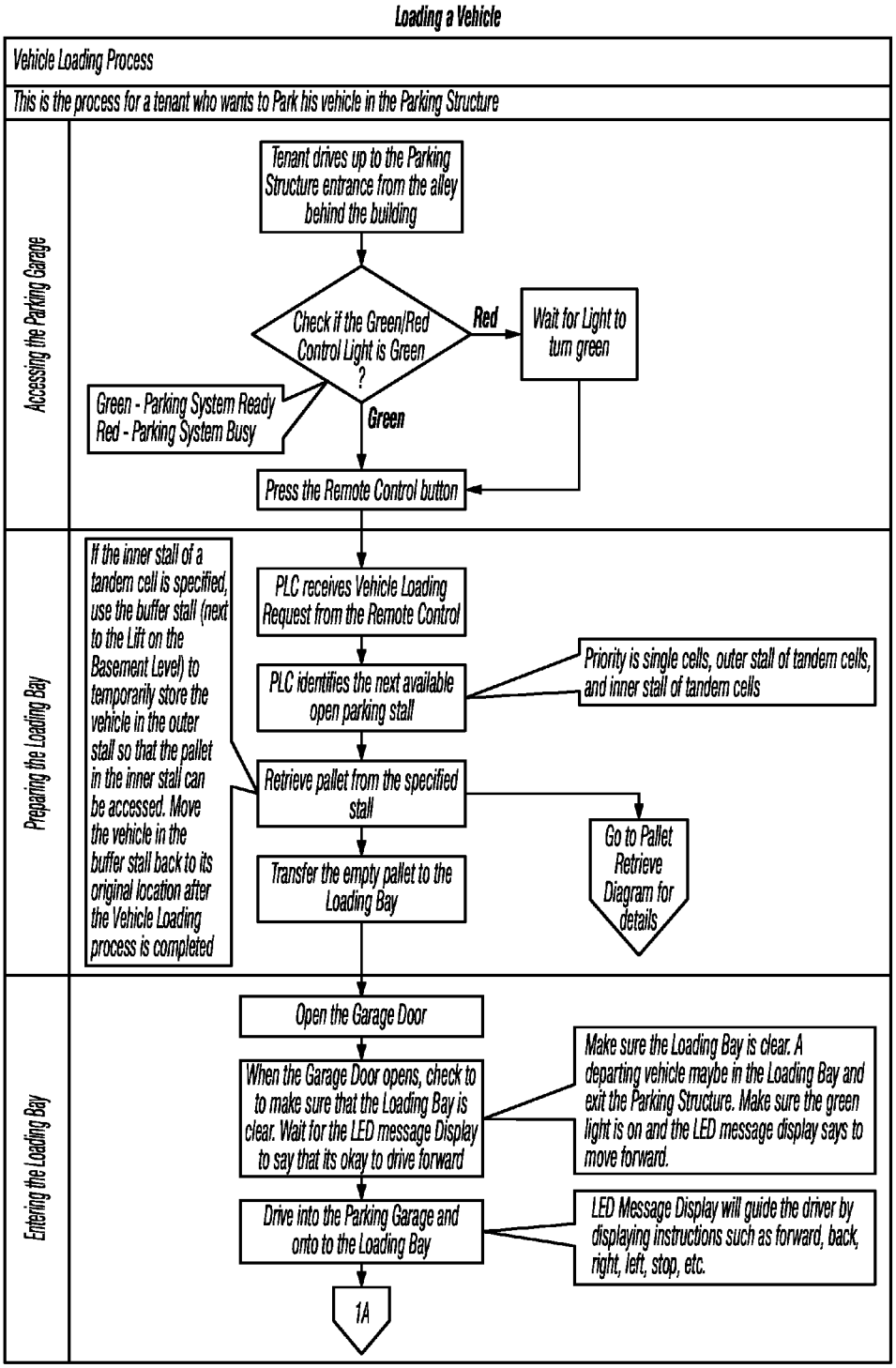
FIGS. 14 through 16 are flow charts illustrating the loading of a vehicle in the automated parking system.
Figure 15:
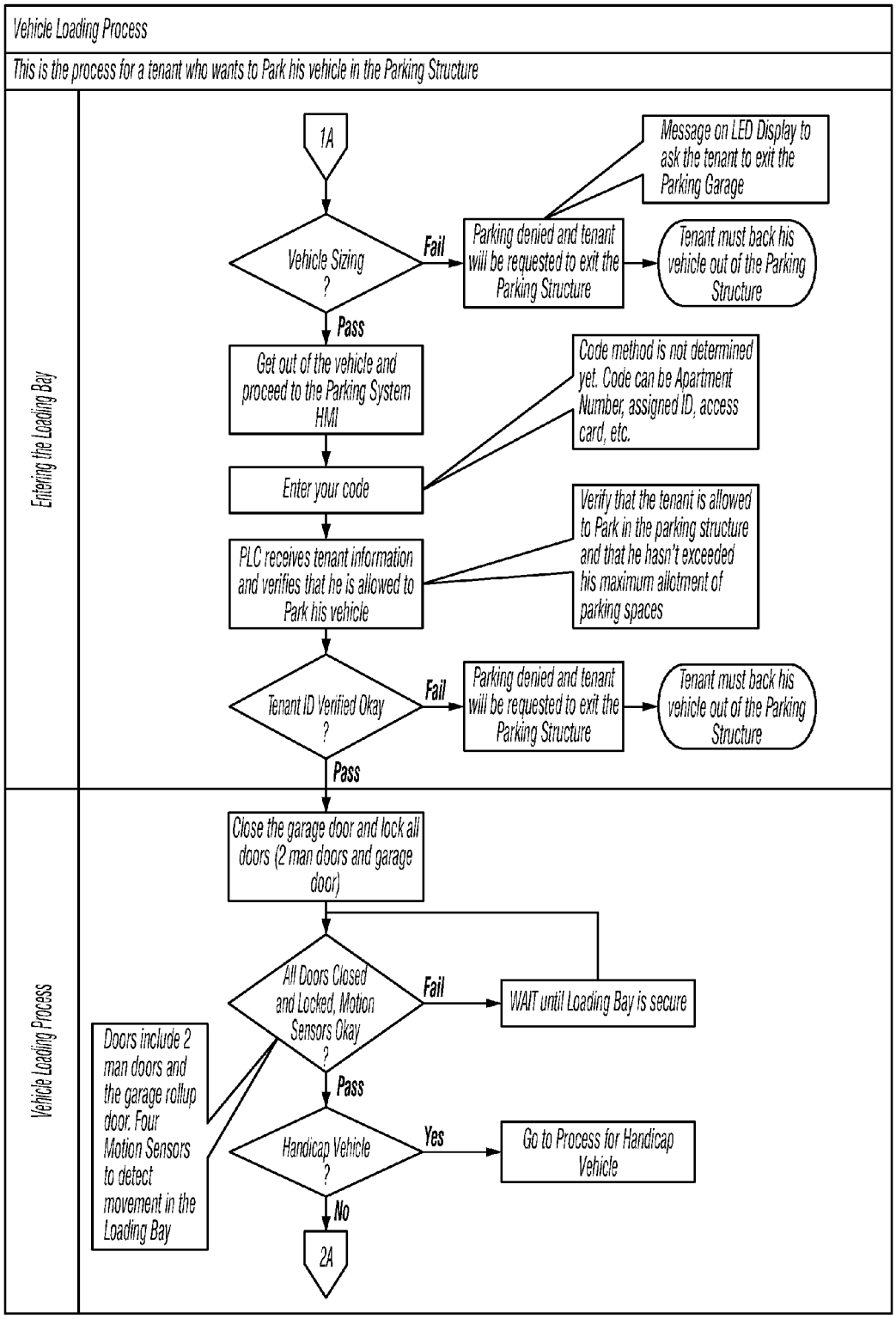
Figure 16:
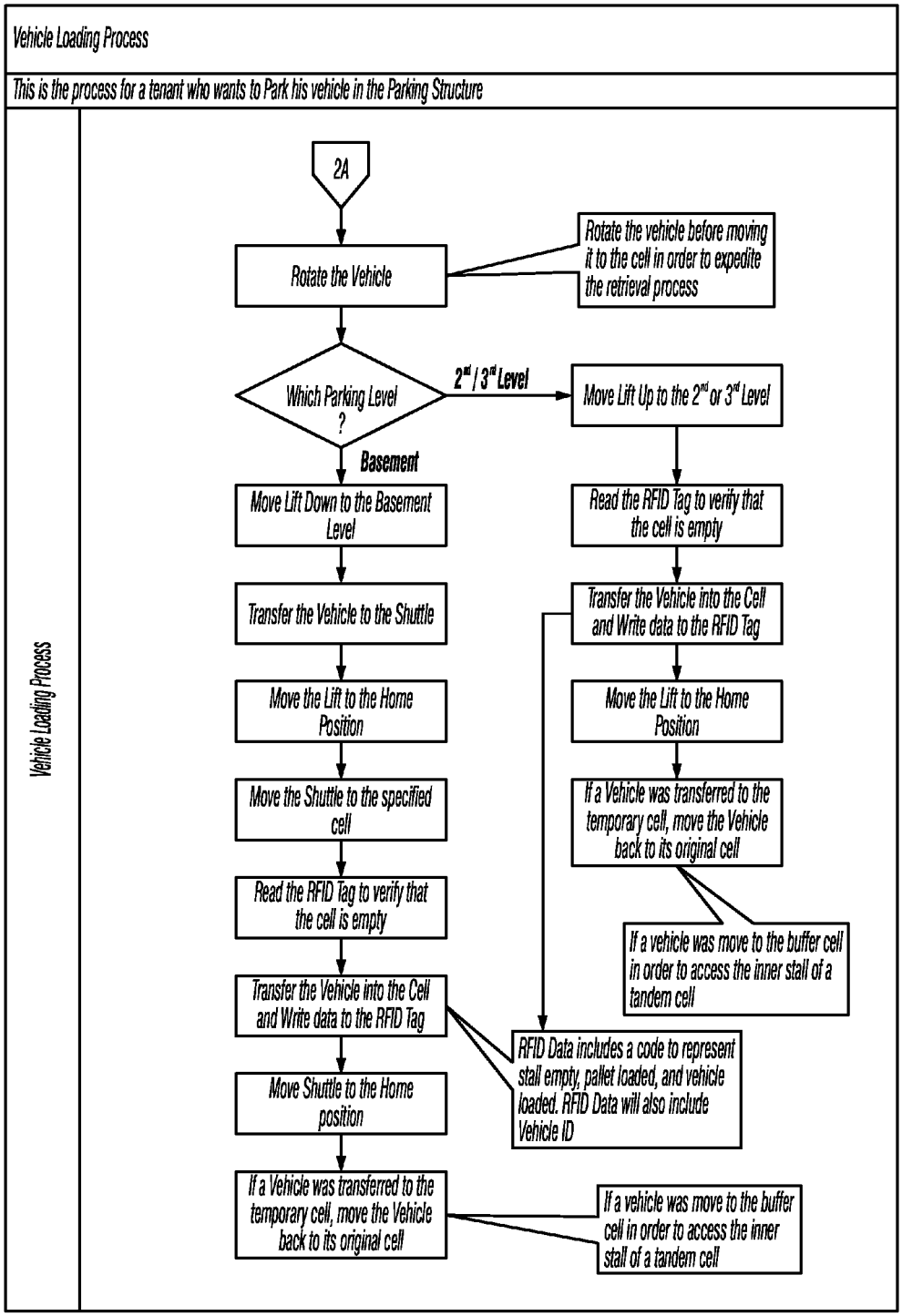
Figure 17:
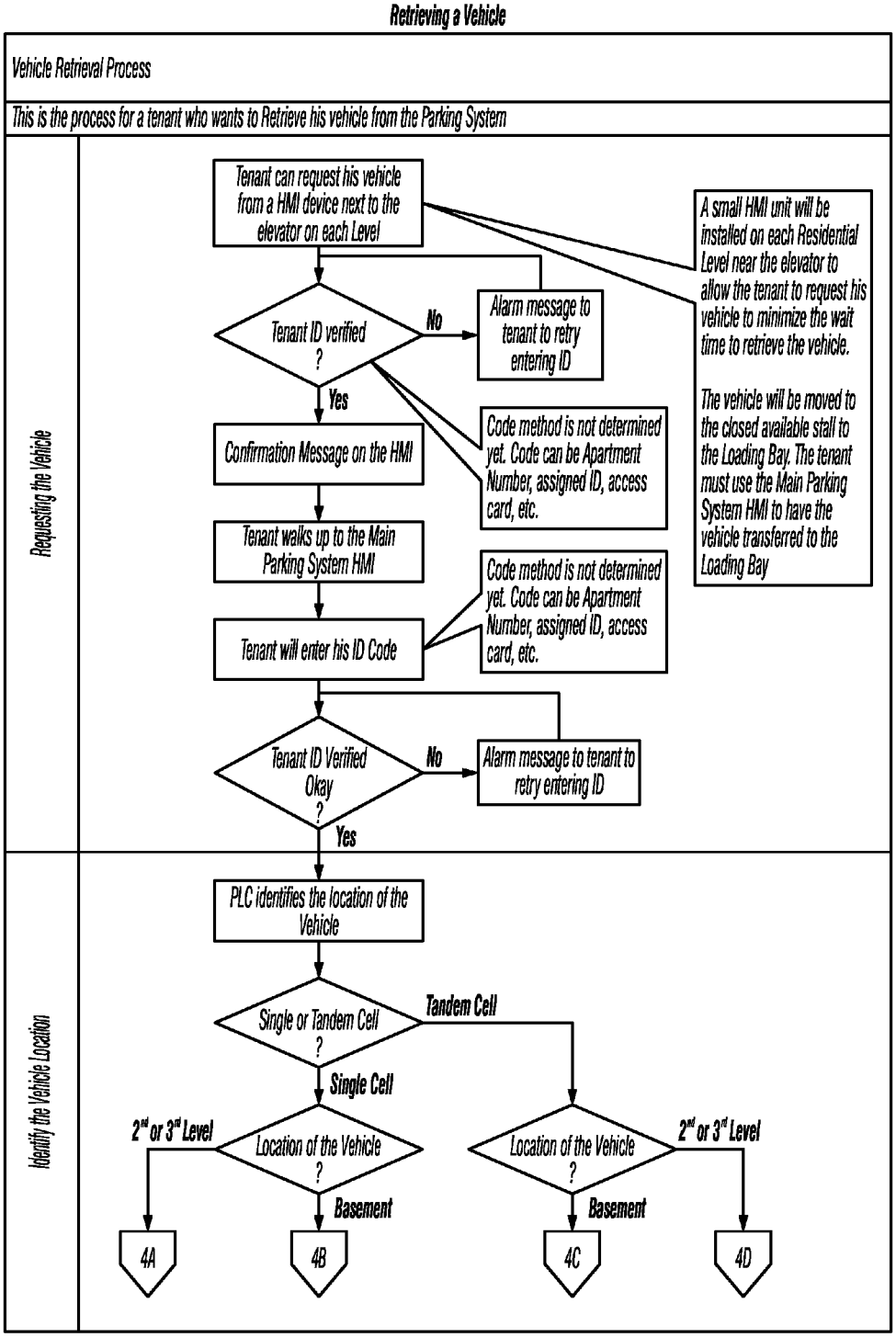
FIGS. 17 through 23 are flow charts illustrating vehicle retrieval from the automated parking system.

The flow charts of FIGS. 14-16 illustrates the loading of a vehicle. After the customer has identified himself on the user interface device 76, the automated parking system 10 initiates the vehicle loading process. The following conditions must be met before the process starts: (i) no alarms exists; (ii) the car fits within the size parameters for the automated parking system 10; (iii) both main doors are closed and locked; (iv) the garage door is closed and locked; and (v) motion sensors 70 do not detect any moving objects or people. As a non-limiting example, four motion sensors 70 can be installed in the loading bay 64 to detect any movement. If any movement is detected, the automated parking system 10 can be instructed to stop.

When all of these conditions are met, the vehicle can be rotated, e.g., 180 degrees, then lowered to the basement level or lifted to the $2^{nd}/3^{rd}$ level parking cells 66. Cell 66 selection can be based on the size of the car and available parking cells 66.

When a vehicle is lowered to the basement level it can be transferred on CDLR conveyors 14 to the shuttle 36. The shuttle 36 receives the vehicle from the lift 62 and moves it horizontally (forward and back) to an open parking cell.

As illustrated in FIG. 6, single parasitic cells 66 can be loaded from the shuttle 36. When the shuttle 36 arrives at the target cell 66, the RFID antenna will read the RFID tag 68 (memory device) attached to the cell 66 and verify that the cell 66 is empty. As the vehicle is loaded into the cell 66, the RFID antenna writes code onto the RFID tag 68 to identify that the cell 66 has a vehicle loaded in it. The conveyors on the parasitic cells 66 are not powered by a motor. Parasitic cells 66 are driven by the shuttle 36 via a parasitic drive mechanism.

Tandem parasitic cells 66 can be loaded from the shuttle 36. When the shuttle 36 arrives at the target cell 66, the RFID antenna reads the RFID tag 68 attached to the cell 66 and verifies that the cell 66 is empty. As the vehicle is loaded into the cell 66, the RFID antenna writes code onto the RFID tag 68 to identify that the cell 66 has a vehicle loaded in it. The conveyors on the parasitic cells 66 need not be powered by a motor. Parasitic cells 66 can be driven by the shuttle 36 via a parasitic drive mechanism. The tandem cells 66 can be loaded from the outer cells 66 first to allow for quicker loading and unloading cycle times. When all of the outer cells 66 are occupied, the automated parking system 10 will start to load the inner cells 66. To load the inner cells 66, the automated parking system 10 will move the vehicle in the outer cell 66 into a buffer (temporary holding) cell 66 so that the inner cell 66 can be accessed. After the inner cell 66 is loaded the vehicle in the buffer cell 66 can be moved back into the outer cell 66. In one embodiment, powered conveyors can be used to transfer vehicles from one section of rack storage to another section.

Single powered cells 66 can be loaded from the lift 62. When the lift 62 arrives at the target cell 66, the RFID antenna reads the RFID tag 68 (memory device) attached to the cell 66 and verifies that the cell 66 is empty. As the vehicle is loaded into the cell 66, the RFID antenna writes code onto the RFID tag 68 to identify that the cell 66 has a vehicle loaded in it. Unlike the shuttle 36, the lift 62 is not equipped with the parasitic drive mechanism. In another embodiment, a parasitic drive 48 is used. The conveyors on the powered cells 66 are equipped with a motor. The vehicle is transferred to the powered cell 66 by motorized CDLR conveyors 14 on the lift 62 and the powered cell 66.

Tandem powered cells 66 can be loaded from the lift 62. When the lift 62 arrives at the target cell 66, the RFID antenna will read the RFID tag 68 (memory device) attached to the cell 66 and verify that the cell 66 is empty. As the vehicle is loaded into the cell 66, the RFID antenna writes code onto the RFID tag 68 to identify that the cell 66 has a vehicle loaded in it. Unlike the shuttle 36, the lift 62 is not equipped with the parasitic drive mechanism. The conveyors on the powered cells 66 are equipped with a motor. The vehicle is transferred to the powered cell 66 by motorized roller conveyors on the lift 62 and the powered cell 66. The tandem cells 66 can be loaded from the outer cells 66 first to allow for quicker loading and unloading cycle times. When all of the outer cells 66 are occupied, the automated parking system 10 will start to load the inner cells 66. To load the inner cells 66, the automated parking system 10 will move the vehicle in the outer cell 66 into a buffer cell 66 so that the inner cell 66 can be accessed. After the inner cell 66 is loaded the vehicle in the buffer cell 66 can be moved back into the outer cell 66.

The flow charts of FIGS. 17-23 illustrates vehicle retrieval. In order to expedite the vehicle retrieval process and minimize the wait time for the customer, a vehicle call device (user interface 76) can be installed next to the elevator on each level. The customer will have the ability to request his vehicle prior to getting on the elevator. When the customer makes a car retrieval request, the vehicle can be moved into the buffer cell 66 or the closest available open cell 66 so that it can be accessed quickly when the customer arrives at the ground level automated parking system user interface. The vehicle will not be transferred to the loading bay 64 so that the automated parking system 10 can be accessible for other users. The customer will have to use the automated parking system user interface to complete the process and have his vehicle delivered to the loading bay 64.

The customer uses the automated parking system user interface 76 to request his vehicle. Using the remote car request devices on the second, third, fourth, and so on floors, and the floor elevators only transfer the vehicle to an open cell 66 closest to the loading bay 64 to allow for quick retrieval of the vehicle. The customer uses the automated parking system user interface 76 to identify himself and initiate the vehicle retrieval process.

The single parasitic cells 66 can be unloaded to the shuttle 36. When the shuttle 36 arrives at the target cell 66, the RFID antenna reads the RFID tag 68 (memory device) attached to the cell 66 and verifies that the cell 66 contains the appropriate vehicle. As the vehicle is unloaded into the shuttle 36, the RFID antenna writes code onto the RFID tag 68 to identify that the cell 66 is empty. The conveyors on the parasitic cells 66 are not powered by a motor. Parasitic cells 66 are driven by the shuttle 36 via a parasitic drive mechanism.

The tandem parasitic cells 66 can be unloaded to the shuttle 36. When the shuttle 36 arrives at the target cell 66, the RFID antenna reads the RFID tag 68 (memory device) attached to the cell 66 and verify that the cell 66 contains the appropriate vehicle. As the vehicle is unloaded into the shuttle 36, the RFID antenna writes code onto the RFID tag 68 to identify that the cell 66 is empty. The conveyors on the parasitic cells 66 are not powered by a motor. Parasitic cells 66 are driven by the shuttle 36 via a parasitic drive mechanism. To unload the inner vehicle of the tandem cell 66, the automated parking system 10 moves the vehicle in the outer cell 66 into a buffer (temporary holding) cell 66 so that the inner vehicle can be accessed. After the inner vehicle is unloaded the vehicle in the buffer cell 66 can be moved back into the outer cell 66.

The conveyors on the powered cells 66 are equipped with a motor. The vehicle is transferred from the powered cell 66 to the lift 62 by motorized roller conveyors on the lift 62 and the powered cell 66. To unload the inner vehicle of the tandem cell 66, the automated parking system 10 moves the vehicle in the outer cell 66 into a buffer cell 66 so that the inner vehicle can be accessed. After the inner vehicle is unloaded the vehicle in the buffer cell 66 can be moved back into the outer cell 66.

The shuttle 36 can be loaded from the parasitic cells 66. The conveyors on the parasitic cells 66 need not be powered by a motor. Parasitic cells 66 can be driven by the shuttle 36 via a parasitic drive mechanism. The drive motor for the parasitic drive system to operate the parasitic cell motor 48 is located on the shuttle 36.

The lift 62 can be loaded from either the shuttle 36 or the powered cells 66. Powered cell conveyors are powered by a motor. The roller conveyors on the shuttle 36 or the powered cells 66 and the roller conveyors on the lift 62 will operate to move the vehicle from the shuttle 36 or powered cell 66 onto the lift 62.

As soon as the lift 62 is loaded with a vehicle (from either the shuttle 36 or a powered cell 66), the lift 62 moves up or down to the ground Level. On the ground Level, the vehicle can be transferred off the lift 62 and onto the loading bay 64.

When the vehicle is on the loading bay 64 and secured into position, the access door and the garage door unlocks. The customer is able to walk out onto the loading bay 64 to his vehicle. The garage door opens and allows the customer to exit the automated parking system 10. The vehicle can be delivered to the loading bay 64 facing the alley. The customer then drives forward out of the automated parking system 10.

Figure 24:
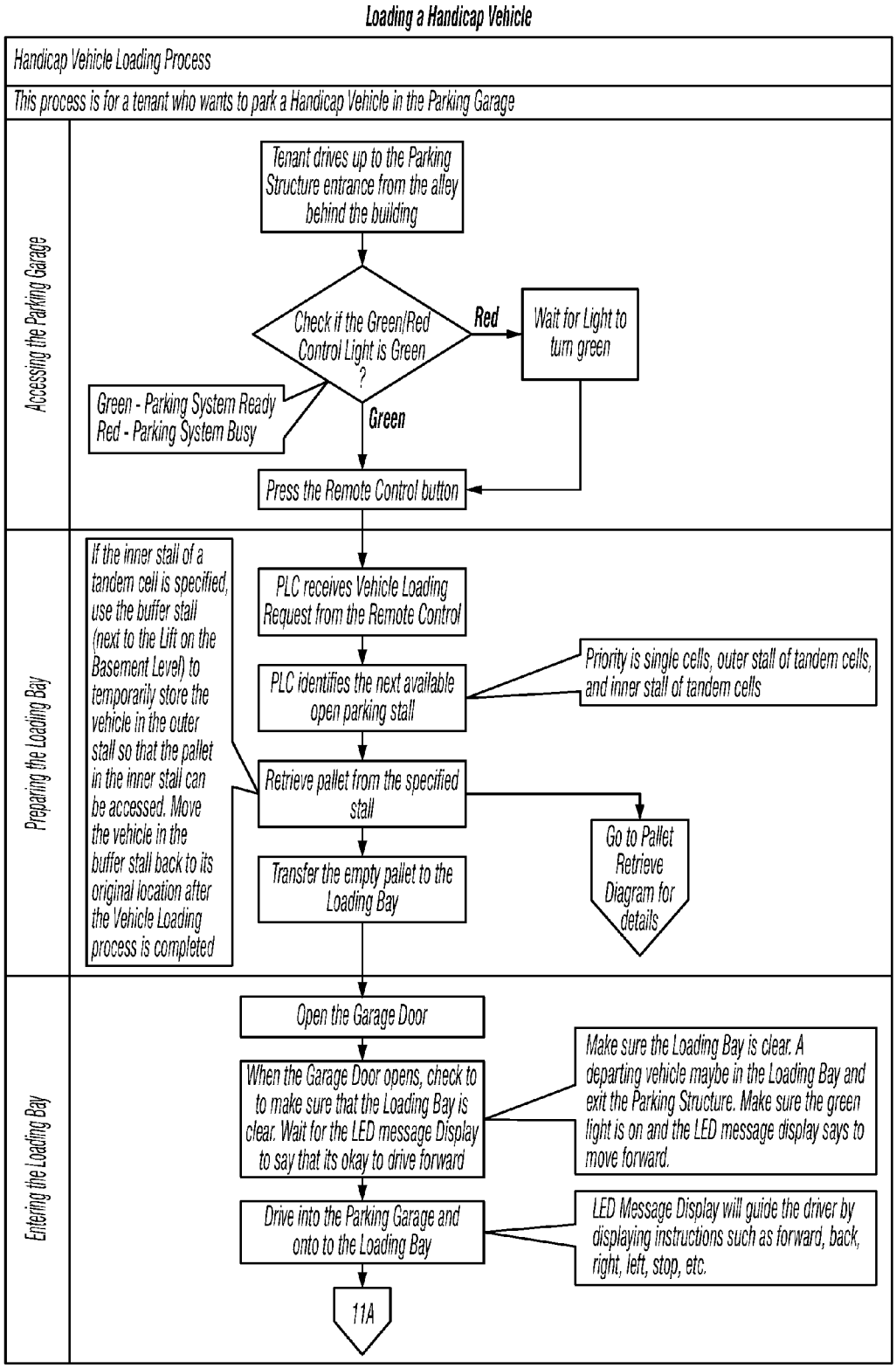
FIGS. 24 and 25 are flow charts illustrating when a handicap vehicle is identified and loaded into a handicap specified cell.
Figure 25:
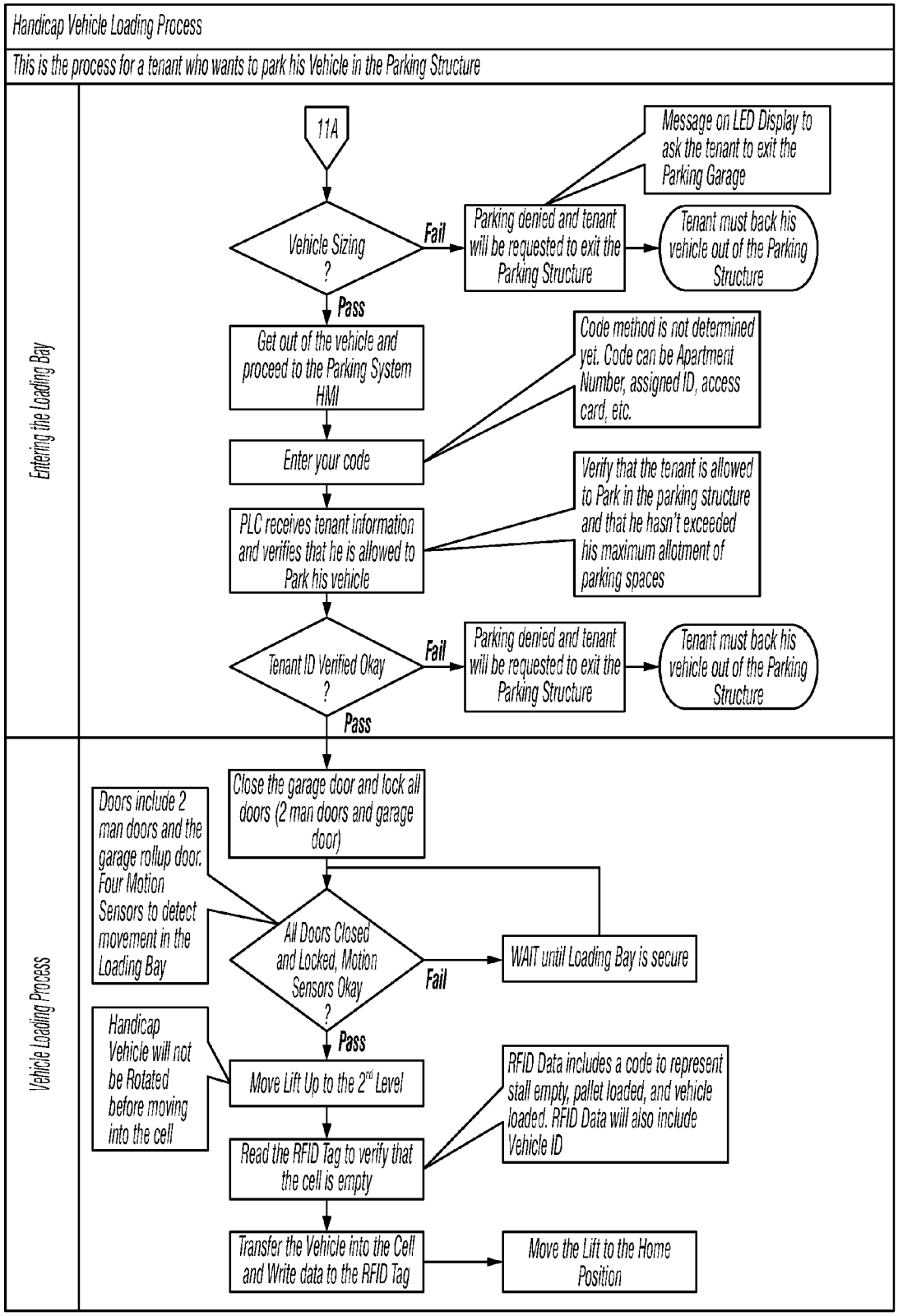

Referring to the flow charts of FIGS. 24 and 25, when a handicap vehicle such as a van is identified by the loading bay sensors 70, the vehicle can be loaded into a handicap specified cell 66 such as on the $2^{nd}$ level. Unlike the standard vehicles, the handicap vehicle is not rotated 180 degrees. Handicap vehicles are backed out of the loading bay 64 when departing the automated parking system 10.

In one embodiment, the automated parking system 10 has a password protected demo mode that can be accessed by the staff. The demo mode allows for information and demonstrations to potential automated parking system 10 clients. The demo mode can have an enhanced set of user interface screens that allow showing of additional features of the automated parking system 10 that maybe required in public paid parking systems, private parking systems, membership or monthly pass type parking systems, and the like. The demo mode can provide a cell 66 selection screen (map of the automated parking system 10 showing which cells 66 are occupied and which are unoccupied) to allow cell 66 selection for the parking demonstration.

Usage data are used to allow for maintenance personnel to be able to track life span of components and warn of potential failures prior to failure. The automated parking system 10 can also track the electrical usage of the motors and can determine prior to failure when a motor has reached the end of its life span and should be replaced. The various data collected can show maintenance personnel where wear and tear may be occurring in the system and helps prevent damage or down time to the system.

Expected variations or differences in the results are contemplated in accordance with the objects and practices of the present invention. It is intended, therefore, that the invention be defined by the scope of the claims which follow and that such claims be interpreted as broadly as is reasonable.

What is claimed is:

1. An automated parking system for a multi-level parking structure, wherein the automated parking system includes a rack structure that is integrated as part of the parking structure, the system comprising:

a controller for receiving a vehicle loading request from a vehicle customer;

a loading bay for accepting the vehicle;

a shuttle for transporting the vehicle horizontally on each level of the parking structure, wherein the shuttle is configured to transport the vehicle horizontally in a continuous operation between loading the vehicle onto the shuttle and removing the vehicle from the shuttle and includes:

a carriage for moving horizontally along powered rails, a plurality of motorized rollers for providing motive power to transport the shuttle along the powered rails, a parasitic drive motor, and a powered conveyor for transferring the vehicle on and off the shuttle;

a first plurality of powered parking cells, each powered parking cell of the plurality of powered parking cells including an RFID tag that includes data to flag whether a specific powered parking cell is occupied or empty, to indicate if a vehicle is present in the specific powered parking cell;

a second plurality of parasitic parking cells, each parasitic parking cell of the plurality of parasitic parking cells having a parasitic conveyor for transferring the vehicle from the shuttle into said parasitic parking cell and including an RFID tag that includes data to flag whether a specific parasitic parking cell is occupied or empty, to indicate if a vehicle is present in the specific parasitic parking cell; and an intelligent Flag controller that triggers a WRITE command in response to the flag from one of the RFID tags, wherein the parasitic drive motor is structured and arranged to mechanically engage the parasitic conveyor of said parasitic parking cell to transfer the vehicle off of the shuttle and into said parasitic parking cell.

2. The system of claim 1, wherein elements of the automated parking system are integrated with the rack structure.

3. The system of claim 1, wherein the powered conveyor comprises a powered chain driven roller system.

4. The system of claim 3, wherein the powered chain driven roller system includes powered rollers that traverse a shuttle carriage.

5. The system of claim 3, wherein the powered chain driven roller system is configured to move the vehicle off the shuttle into or onto at least one of a parking cell and a lift.

6. The system of claim 3, wherein powered chain driven roller system is configured to transfer the vehicle from at least one of a parking cell and a lift onto the shuttle.

7. The system of claim 1, wherein the parasitic drive motor includes a mechanical drive configuration that engages the parasitic conveyor of said parasitic parking cell.

8. The system of claim 1, wherein the automated parking system further includes an empty pallet associated with an open parking cell.

9. The system of claim 1, wherein the automated parking system further includes one or more lifts for transporting the vehicle vertically between levels.

10. The system of claim 9, wherein each lift is integrated with the loading bay.

11. The system of claim 9, wherein each lift is separate from the loading bay.

12. The system of claim 9, wherein the shuttle is configured to move the vehicle horizontally from the one or more lifts to one of the plurality of parking cells for storage, and from that parking cell back to the one or more lifts for departure.

13. The system of claim 9, wherein the shuttle is configured to transfer the vehicle from the loading bay to at least one of a lift for vertical transportation and a parking cell for storage.

14. The system of claim 1, further comprising:

garage doors.

15. The system of claim 14, further comprising:

sensors coupled to the garage doors to detect motion in the loading bay.

16. The system of claim 1, further comprising:

an alarm.

17. The system of claim 1, further comprising:

a user interface.

18. A vehicle parking control system for a parking structure, comprising:

a controller for receiving a vehicle loading request from a vehicle customer;

a loading bay at the parking structure for receiving a customer vehicle;

sensors positioned to determine one or more dimensions of the customer vehicle;

an electronic verification device for verifying a customer ID;

a first plurality of powered parking cells, each powered parking cell of the plurality of powered parking cells including an RFID tag that includes data to flag whether a specific powered parking cell is occupied or empty, to indicate if a vehicle is present in the specific powered parking cell;

a second plurality of parasitic parking cells, each parasitic parking cell of the plurality of parasitic parking cells having a parasitic conveyor for transferring the customer vehicle into said parasitic parking cell and including an RFID tag that includes data to flag whether a specific parasitic parking cell is occupied or empty, to indicate if a vehicle is present in the specific parasitic cell;

a shuttle for transferring the customer vehicle to one of the specific powered or parasitic parking cells, wherein the shuttle is configured to transport the customer vehicle horizontally in a continuous operation between loading the customer vehicle onto the shuttle and removing the customer vehicle from the shuttle and includes:

a carriage for moving horizontally along powered rails, a plurality of motorized rollers for providing motive power to transport the shuttle along the powered rails, a parasitic drive motor, and a powered conveyor for transferring the customer vehicle on and off the shuttle; and an intelligent Flag controller that triggers a WRITE command in response to the flag from one of the RFID tags, wherein the parasitic drive motor is structured and arranged to mechanically engage the parasitic conveyor of said parasitic parking cell to transfer the vehicle off of the shuttle and into said parasitic parking cell.

19. The system of claim 18, wherein the parking control system is integrated with the parking structure.

20. The system of claim 18, further comprising:

a lift to move the shuttle to a selected floor of the parking structure.

21. The system of claim 18, wherein each RFID tag includes a code to represent at least one of an empty parking cell, pallet loaded, vehicle loaded, and vehicle ID.

22. The system of claim 18, further comprising:

a buffer cell used prior to positioning the customer vehicle in one of the parking cells.

23. The system of claim 18, wherein the first and second pluralities of parking cells are arranged in stackable configurations.

24. The system of claim 18, wherein the parasitic drive motor includes a mechanical drive configuration that engages the parasitic conveyor of said parasitic parking cell.

* * * * *

UNITED STATES PATENT AND TRADEMARK OFFICE

CERTIFICATE OF CORRECTION

PATENT NO. : 8,632,290 B2
APPLICATION NO. : 13/008578
DATED : January 21, 2014
INVENTOR(S) : Alan It is certified that error appears in the above-identified patent and that said Letters Patent is hereby corrected as shown below:

In the Claims

Claim 18, column 18, line 27, reads "a vehicle is present in the specific parasitic cell;" but should read -- a vehicle is present in the specific parasitic parking cell; --

Signed and Sealed this
Fifteenth Day of April, 2014

Michelle K. Lee

Michelle K. Lee
*Deputy Director of the United States Patent and Trademark Office*